US007177560B2

(12) United States Patent
Fujisawa

(10) Patent No.: US 7,177,560 B2
(45) Date of Patent: Feb. 13, 2007

(54) METHOD OF WARMING FIXING DEVICE, METHOD OF DETERMINING HUMIDITY VALUE USED IN IMAGE FORMATION APPARATUS, AND IMAGE FORMATION APPARATUS

(75) Inventor: Kazutoshi Fujisawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 160 days.

(21) Appl. No.: 10/948,107

(22) Filed: Sep. 23, 2004

(65) Prior Publication Data

US 2005/0095022 A1 May 5, 2005

(30) Foreign Application Priority Data

Sep. 24, 2003 (JP) ..... P2003-332357
Sep. 24, 2003 (JP) ..... P2003-332358

(51) Int. Cl.
*G03G 15/00* (2006.01)
*G03G 15/20* (2006.01)

(52) U.S. Cl. ..... 399/44; 399/69; 399/70

(58) Field of Classification Search ..... 219/216; 399/44, 45, 46, 66, 67, 69, 70, 97
See application file for complete search history.

(56) References Cited

U.S. PATENT DOCUMENTS 6,389,247 B1 * 5/2002 Chung ..... 399/69

FOREIGN PATENT DOCUMENTS

| | | |
|---|---|---|
| JP | 09-034302 | 2/1997 |
| JP | 2000-039780 | 2/2000 |
| JP | 2000-214723 | 8/2000 |
| JP | 2001-134132 | 5/2001 |
| JP | 2002-258652 | 9/2002 |
| JP | 2002-296929 | 10/2002 |
| JP | 2003-302861 | 10/2003 |

* cited by examiner

*Primary Examiner*—Hoang Ngo
(74) *Attorney, Agent, or Firm*—Hogan & Hartson LLP

(57) ABSTRACT

A method of warming a fixing device includes the steps of: providing a first fixing member and a second fixing member for fixing a toner image onto a sheet, a temperature increase rate of the first fixing member being higher than that of the second fixing member; warming up the first fixing member until a first temperature when humidity is low based on humidity information; and performing an additional warm-up of the fixing device for a predetermined time after warming up the first fixing member until the first temperature, when the humidity is high.

16 Claims, 10 Drawing Sheets

FIG. 6

| | | | | | | |
|---|---|---|---|---|---|---|
| | ENVIRONMENTAL MOISTURE | 50% | 60% | 70% | 80% | 85% |
| | PAPER WATER CONTENT | 5% | 7% | 8% | 11% | 13% |
| ONLY USUAL WARM-UP | WARM-UP TIME | 90SEC | 90SEC | 88SEC | 88SEC | 90SEC |
| | PRESSURIZATION ROLLER TEMPERATURE | 115°C | 113°C | 113°C | 112°C | 112°C |
| | NO PAPER JAM: OCCURRENCE OF PAPER JAM | O | O | O | X | X |
| USUAL WARM-UP + ADDITIONAL WARM-UP | WARM-UP TIME | 88SEC | 90SEC | 121SEC | 117SEC | 118SEC |
| | PRESSURIZATION ROLLER TEMPERATURE | 114°C | 115°C | 137°C | 138°C | 138°C |
| | NO PAPER JAM: OCCURRENCE OF PAPER JAM | O | O | O | O | O |

FIG. 7

| SITUATION | TEMPERATURE OF FIXING ROLLER | DETERMINED HUMIDITY VALUE | HUMIDITY DETERMINATION | WARM-UP | PAPER JAM |
|---|---|---|---|---|---|
| 1. POWER SWITCH ON AFTER OFF FOR LONG TIME | 25°C | MEASUREMENT VALUE: 75% | > 70% | ADDITIONAL | NO |
| 2. AFTER COVER OPEN AND CLOSED | 180°C | STORAGE VALUE: 75% | > 70% | ADDITIONAL | NO |
| 3. RETURN FROM 5-MINUTE STANDBY STATE | 120°C | STORAGE VALUE: 75% | > 70% | ADDITIONAL | NO |
| 4. RETURN FROM 1-HOUR STANDBY STATE | 30°C | STORAGE VALUE: 75% | > 70% | ADDITIONAL | NO |
| 5. POWER SWITCH ON AFTER POWER OFF FOR 10 MIN | 100°C | STORAGE VALUE: 75% | > 70% | ADDITIONAL | NO |
| 6. POWER SWITCH ON AFTER POWER OFF FOR 1 HR | 30°C | MEASUREMENT VALUE: 75% | > 70% | ADDITIONAL | NO |

FIG. 8

| SITUATION | TEMPERATURE OF FIXING ROLLER | MEASURED HUMIDITY VALUE | DETERMINED HUMIDITY VALUE | HUMIDITY DETERMINATION | WARM-UP | PAPER JAM |
|---|---|---|---|---|---|---|
| 1. POWER SWITCH ON AFTER OFF FOR LONG TIME | 25°C | 75% | MEASUREMENT VALUE: 75% | > 70% | ADDITIONAL | NO |
| 2. AFTER COVER OPEN AND CLOSED | 180°C | | STORAGE VALUE: 75% | > 70% | ADDITIONAL | NO |
| 3. RETURN FROM 5-MINUTE STANDBY STATE | 120°C | | STORAGE VALUE: 75% | > 70% | ADDITIONAL | NO |
| 4. RETURN FROM 1-HOUR STANDBY STATE | 30°C | 68% | CORRECTED VALUE: 75% | > 70% | ADDITIONAL | NO |
| 5. POWER SWITCH ON AFTER POWER OFF FOR 10 MIN | 100°C | | STORAGE VALUE: 75% | > 70% | ADDITIONAL | NO |
| 6. POWER SWITCH ON AFTER POWER OFF FOR 1 HR | 30°C | 73% | MEASUREMENT VALUE: 75% | > 70% | ADDITIONAL | NO |

FIG. 9

| SITUATION | TEMPERATURE OF INTERNAL DEVICE | MEASURED HUMIDITY VALUE | HUMIDITY DETERMINATION | WARM-UP | PAPER JAM |
|---|---|---|---|---|---|
| 1. POWER SWITCH ON AFTER OFF FOR LONG TIME | 25°C | 76% | > 70% | ADDITIONAL | NO |
| 2. AFTER COVER OPEN AND CLOSED | 40°C | 54% | < 70% | NORMAL | OCCURRED |
| 3. RETURN FROM 5-MINUTE STANDBY STATE | 38°C | 58% | < 70% | NORMAL | OCCURRED |
| 4. RETURN FROM 1-HOUR STANDBY STATE | 30°C | 68% | < 70% | NORMAL | OCCURRED |
| 5. POWER SWITCH ON AFTER POWER OFF FOR 10 MIN | 35°C | 60% | < 70% | NORMAL | OCCURRED |
| 6. POWER SWITCH ON AFTER POWER OFF FOR 1 HR | 26°C | 76% | > 70% | ADDITIONAL | NO |

METHOD OF WARMING FIXING DEVICE, METHOD OF DETERMINING HUMIDITY VALUE USED IN IMAGE FORMATION APPARATUS, AND IMAGE FORMATION APPARATUS

BACKGROUND OF THE INVENTION

This invention relates to a method of warming up a fixing device in an image formation apparatus such as a printer, a facsimile, or a copier for forming an image using electrophotography, an image formation apparatus using the method and a method of determining a humidly value used in the image formation apparatus.

Generally, an image formation apparatus using electrophotography includes a photoconductor having a photosensitive layer on an outer peripheral surface thereof, a charging member for uniformly charging the outer peripheral surface of the photoconductor, a light exposure member for selectively exposing the outer peripheral surface uniformly charged by the charging member to light for forming an electrostatic latent image, a developing member for providing toner as a developer to the electrostatic latent image formed by the light exposure member for producing a visible image (toner image), a transfer member for transferring the toner image developed by the developing member to a paper as a transfer target, and a fuser for fixing the toner image onto the paper to which the toner image has been transferred by the transfer member.

Known as an image formation apparatus in a related art is an image formation apparatus including a temperature sensor and a humidity sensor for determining a transfer voltage in response to the temperature and the humidity detected by the sensors. (For example, refer to JP-A-2000-039780 (paragraph and FIG. 1)).

A fuser in a related art has at least two fixing members for forming a fixing nip part. For example, one fixing member is implemented as a fixing roller (or a fixing belt) which has a heating member and is rotated, and the other is implemented as a pressurization member (for example, a pressurization roller) pressed against the one fixing member for rotation (see, JP-A-2000-214723, JP-A-2002-258652 and JP-A-2001-134132, for example).

When the image formation apparatus performs an image formation operation, a warm-up operation of the fuser is performed. The warm-up operation is performed until the fixing roller, etc., reaches a predetermined temperature as the heating member heats the fixing roller, etc., and the pressurization member while the fixing roller, etc., and the pressurization member are rotated. The pressurization member is heated by heat conduction from the fixing roller, etc.

Generally, when the power is turned on, the fuser is warmed up; if no print signal is input for a predetermined time, a standby state is entered for power saving and later when a print signal is input, the fuser is warmed up.

After the completion of the warm-up operation, the record medium, on which the toner image is formed, is passed through the nip part, whereby the toner is fused on the paper.

Generally, PI-based or silicon-based material used with an electric insulation layer or an adhesive layer of the fixing roller and the pressurization member and so on has a water absorption property. Thus, if it is let alone for a long time in a high-humidity environment in the rainy season, etc., the fixing roller absorbs water content. If the temperature of the fixing roller rapidly is risen in a state that the fixing roller has the water content, the water content in the electric insulation layer and the adhesive layer is vaporized and expanded in a stroke and a heat element and the electric insulation layer are pushed up from a core. Accordingly, adhesion of the heat element, the electric insulation layer, and the core are completely broken and peels. If the constitution of the adhesive layer is thus broken and the heat element and the electric insulation layer float, the heat conduction from the heat element to the core is hindered and thus local heating of the heat element occurs, etc., causing a failure to occur.

The following fuser is known as a fuser in a related art: a humidity detection member is provided in the proximity of a fixing roller in apparatus and the temperature increase rate of the fixing roller is changed in response to the humidity condition in the apparatus just after power is turned on, namely, if the humidity in the apparatus is higher than a reference value, the water absorption state in an electric insulation layer and an adhesive layer is determined to be high, and the temperature increase rate of the fixing roller is decreased for evaporating the water content in the electric insulation layer and the adhesive layer gradually over a period of time, thereby preventing trouble caused by destruction of the electric insulation layer caused by rapid vaporization and expansion (For example, refer to JP-A-2000-214723).

In the image formation apparatus described in JP-A-2000-214723, a transfer member is housed in the apparatus and thus it is appropriate to place the humidity sensor for controlling the transfer voltage in the apparatus and control the image formation apparatus (transfer voltage) based on the humidity value provided any time by the humidity sensor.

On the other hand, in the image formation apparatus, it may be undesirable to control the image formation apparatus based on the humidity value provided any time by the humidity sensor placed in the apparatus.

For example, if paper supplied to the image formation apparatus is set in the image formation apparatus from the state in which the paper is placed outside the apparatus or is previously set in the image formation apparatus, usually the set position is a position easily affected by the environment outside the apparatus. In such a case, it is undesirable to perform control concerning paper based on the humidity value provided any time by the humidity sensor placed in the apparatus, because when the image formation apparatus operates, the internal humidity gradually differs from the environmental moisture (usually, goes lower than the environmental moisture).

SUMMARY OF THE INVENTION

It is therefore a first object of the invention to provide a desirable humidity value determination method in the case where it is undesirable to perform control based on the humidity value provided any time by a humidity sensor placed in an apparatus and an image formation apparatus using the method.

In a fuser wherein only one of two or more fixing members forming a fixing nip part is provided with a heating member or in a fuser wherein although another fixing member is also provided with a heating member, there is a heat capacity difference between the fixing members or a thermal capability difference between the heating members, a large temperature difference may occur between the fixing members upon completion of the warm-up operation. For example in a fuser wherein a pressurization roller having no heat source is pressed against a fixing roller having a heating member, the pressurization roller is mainly heated only through the press part against the fixing roller (fixing nip part) and thus upon completion of the warm-up operation, the pressurization roller is at low temperature as compared with the fixing roller and a large temperature difference occurs between the pressurization and fixing rollers.

Under such circumstances, if sheet placed in a high-humidity environment and absorbing much water content passes through the fixing nip part, a difference in the dry degree occurs between both sides of the sheet. The side facing the high-temperature fixing member (for example, fixing roller) is well dried and the side facing the low-temperature fixing member (for example, pressurization roller) is not much dried.

Thus, it was found that the sheet passing through the fixing nip part curls largely so that the well dried side shrinks, causing problems of a sheet jam, wrinkle occurrence, etc.

It is therefore a second object of the invention to provide a warm-up method of a fuser for making a sheet jam, wrinkle occurrence, etc., hard to occur and an image formation apparatus using the method.

To the end, according to the invention, there is provided a method of warming a fixing device, comprising the steps of:

providing a first fixing member and a second fixing member for fixing a toner image onto a sheet, a temperature increase rate of the first fixing member being higher than that of the second fixing member;

warming up the first fixing member until a first temperature when humidity is low based on humidity information; and performing an additional warm-up of the fixing device for a predetermined time after warming up the first fixing member until the first temperature, when the humidity is high.

Preferably, the additional warm-up is performed by warming up the second fixing member until a second temperature.

Preferably, the second temperature is lower than the first temperature.

According to the present invention, there is also provided an image formation apparatus, comprising:

a first fixing member, a second fixing member, which is arranged in contact with the first fixing member for fixing a toner image onto a sheet, a temperature increase rate of the first fixing member being higher than that of the second fixing member;

a humidity sensor, which measures humidity; and a controller, which controls a warming up of the first fixing member and the second fixing member, wherein the first fixing member is warmed up until a first temperature when a humidity measured by the humidity sensor is low; and wherein when the humidity is high, an additional warm-up of the fixing device is performed for a predetermined time after the first fixing member is warmed up until the predetermined temperature.

Preferably, the image formation apparatus further comprising a temperature sensor which measures temperature of the second fixing member. The controller performs the additionally warm up to the fixing device until the second fixing member is warmed up until a second temperature, based on the temperature measured by the temperature sensor.

Preferably, the second temperature is lower than the first temperature.

Thus, according to the method, the following advantages can be provided:

When the humidity is low, the fuser is warmed up until the fixing member whose temperature increase rate is higher than that of the other reaches the predetermined temperature. That is, usual warm-up is executed. Then, sheet passes through a fixing nip part of the fixing device. In this case, the sheet was in the low-humidity environment and does not absorb much water content.

Thus, if there is a comparatively large temperature difference between the fixing members, a large difference in the dry degree does not occur between both sides of the sheet and therefore the sheet passing through the fixing nip part does not curl largely.

Consequently, problems of a sheet jam, wrinkle occurrence, etc., become hard to occur.

On the other hand, when the humidity is high, the fuser is additionally warmed up for the predetermined time after the fixing member whose temperature increase rate is higher reaches the predetermined temperature. As the additional warm-up is executed, the fixing member whose temperature increase rate is lower is furthermore heated, so that the temperature difference between the fixing members lessens.

Therefore, later, if sheet placed in the high-humidity environment and absorbing much water content passes through the fixing nip part, a large difference in the dry degree does not occur between both sides of the sheet and therefore the sheet passing through the fixing nip part does not curl largely.

Consequently, problems of a sheet jam, wrinkle occurrence, etc., also become hard to occur in the high-humidity environment.

If the additional warm-up is executed until the fixing member whose temperature increase rate is lower than that of the other reaches a predetermined temperature, the temperature difference between the fixing members can be reliably placed within a given value, a curl of the sheet passing through the fixing nip part is suppressed more reliably, and it is made possible to more reliably suppress occurrence of problems of a sheet jam, wrinkle occurrence, etc., in the high-humidity environment.

The image formation apparatus of the invention is an image formation apparatus including a fuser having at least two fixing members for forming a fixing nip part, the two fixing members being different in a temperature increase rate at the warm-up time, the image formation apparatus further including:

a humidity sensor for measuring humidity; and a controller for warming up the fuser until the fixing member whose temperature increase rate is higher than that of the other reaches a predetermined temperature when humidity is low based on the humidity measured by the humidity sensor, and when the humidity is high, the controller for additionally warming up the fuser for a predetermined time after the fixing member whose temperature increase rate is higher reaches the predetermined temperature. Thus, according to the image formation apparatus, the following advantages can be provided:

The humidity sensor measures the humidity and the controller performs the following control based on the measurement result:

When the humidity is low, the controller warms up the fuser until the fixing member whose temperature increase rate is higher than that of the other reaches the predetermined temperature. That is, usual warm-up is executed. Then, sheet passes through the fixing nip part. In this case, the sheet was in the low-humidity environment and does not absorb much water content.

Thus, if there is a comparatively large temperature difference between the fixing members, a large difference in the dry degree does not occur between both sides of the sheet and therefore the sheet passing through the fixing nip part does not curl largely.

Consequently, problems of a sheet jam, wrinkle occurrence, etc., become hard to occur.

On the other hand, when the humidity is high, the controller additionally warms up the fuser for the predetermined time after the fixing member whose temperature increase rate is higher reaches the predetermined temperature. As the additional warm-up is executed, the fixing member whose temperature increase rate is lower is furthermore heated, so that the temperature difference between the fixing members lessens.

Therefore, later, if sheet placed in the high-humidity environment and absorbing much water content passes through the fixing nip part, a large difference in the dry degree does not occur between both sides of the sheet and therefore the sheet passing through the fixing nip part does not curl largely.

Consequently, problems of a sheet jam, wrinkle occurrence, etc., also become hard to occur in the high-humidity environment.

If a temperature sensor is provided for measuring temperature of the fixing member whose temperature increase rate is lower than that of the other and the controller is a controller for additionally warming up the fuser until the fixing member whose temperature increase rate is lower reaches a predetermined temperature based on the temperature measured by the temperature sensor, the temperature difference between the fixing members can be reliably placed within a given value, a curl of the sheet passing through the fixing nip part is suppressed more reliably, and it is made possible to more reliably suppress occurrence of problems of a sheet jam, wrinkle occurrence, etc., in the high-humidity environment.

If the predetermined temperature applied to the fixing member whose temperature increase rate is lower is made lower than the predetermined temperature applied to the fixing member whose temperature increase rate is higher, the time required for the additional warm-up can be shortened.

According to the present invention, there is also provided a method of determining a humidly value used in an image formation apparatus, comprising the steps of:

measuring humidity in the image formation apparatus immediately after a power of the image forming apparatus is turned on;

storing a first humidity value measured in the measuring step; and determining the first humidity value as a value used for controlling the image formation apparatus until the power is turned off.

Preferably, the method further comprising the steps of:

measuring temperature of a fixing member for fixing an toner image onto a sheet, when the power is again turned on;

determining the stored first humidity value as the value used for controlling the image formation apparatus until the power is turned off, when the measured temperature is equal to or greater than a predetermined value;

remeasuring the humidity in the image formation apparatus and storing a second humidity value measured in the remeasuring step, when the measured temperature is less than the predetermined value; and determining the second humidity value as the value used for controlling the image formation apparatus until the power is turned off.

According to the present invention, there is also provided an image formation apparatus, comprising:

a humidity sensor, which measures humidity in the image formation apparatus immediately after a power of the image forming apparatus is turned on;

a storage, which stores a humidity value measured by the humidity sensor; and a controller, which determines the humidity value as a value used for controlling the image formation apparatus until the power is turned off.

According to the present invention, there is also provided an image formation apparatus, comprising:

a fixing member, which fixes a toner image onto a sheet;

a temperature sensor, which measures temperature of the fixing member;

a humidity sensor, which measures humidity in the image formation apparatus;

a storage, which is capable of storing a humidity value measured by the humidity sensor; and a controller, which determines the humidity value as a value used for controlling the image formation apparatus until the power is turned off, wherein the humidity sensor measures the humidity in the image formation apparatus immediately after the power is turned on;

wherein a first humidity value measured by the humidity sensor is stored in the storage;

wherein the first humidity value is determined as the value used for controlling the image formation apparatus until the power is turned off;

wherein the temperature of the fixing member is measured when the power is again turned on;

wherein the first humidity value stored in the storage is determined as the value used for controlling the image formation apparatus until the power is turned off, when the measured temperature is equal to or greater than a predetermined value;

wherein the humidity in the image formation apparatus is remeasured by the humidity sensor and a second humidity value remeasured by the humidity sensor is stored in the storage, when the measured temperature is less than the predetermined value; and wherein the second humidity value is determined as the value used for controlling the image formation apparatus until the power is turned off.

According to the present invention, there is also provided a method of determining a humidly value used in an image formation apparatus, comprising the steps of:

setting the image formation apparatus to a standby state when an image forming signal is not input for a predetermined time in on state of the image formation apparatus;

warming up a fixing member of the image forming apparatus when the image forming signal is input;

measuring temperature of the fixing member immediately after the image forming signal is input;

measuring humidity in the image formation apparatus when the temperature measured in the temperature step is less than a predetermined value;

correcting a humidity value measured in the humidity measuring step with a correction value; and determining the corrected humidity value as a value used for controlling the image formation apparatus until the power is turned off.

According to the present invention, there is also provided an image formation apparatus, in which the image formation apparatus is set to a standby state when an image forming signal is not input for a predetermined time in on state of the image formation apparatus, comprising:

a fixing device, which is warmed up when the image forming signal is input;

a temperature sensor, which measures temperature of the fixing device;

a humidity sensor, which measures humidity in the image formation apparatus; and a controller, which determines a humidity value as a value used for controlling the image formation apparatus until the power is turned off. The temperature sensor measures the temperature of the fixing device immediately after the image forming signal is input. The humidity sensor measures the humidity in the image formation apparatus when the measured temperature is less than a predetermined value. A humidity value measured by the humidity sensor is corrected with a correction value. The corrected humidity value is determined as the value used for controlling the image formation apparatus until the power is turned off.

Preferably, the method further comprising the steps of:

providing a first fixing member and a second fixing member for fixing a toner image onto a sheet, a temperature increase rate of the first fixing member being higher than that of the second fixing member;

warming up the first fixing member until a first temperature, when the humidity value determined in the determining step is equal to or less than a predetermined value; and performing an additional warm-up of the fixing device for a predetermined time after warming up the first fixing member until the first temperature, when the humidity value determined in the determining step is greater than the predetermined value.

Preferably, the additional warm-up is performed by warming up the second fixing member until a second temperature.

Preferably, the second temperature is lower than the first temperature.

Preferably, the fixing device has a first fixing member and a second fixing member which is arranged in contact with the first fixing member. A temperature increase rate of the first fixing member is higher than that of the second fixing member. The controller controls a warming up of the first fixing member and the second fixing member. The first fixing member is warmed up until a first temperature when the humidity value determined by the controller is equal to or less than a predetermined value. When the humidity value determined by the controller is greater than the predetermined value, an additional warm-up of the fixing device is performed for a predetermined time after the first fixing member is warmed up until the predetermined temperature.

Preferably, the temperature sensor measures temperature of the second fixing member. The controller performs the additionally warm up to the fixing device until a temperature of the second fixing member is reached to a second temperature, based on the temperature measured by the temperature sensor.

Preferably, the second temperature is lower than the first temperature.

According to the above method of the invention, the humidity in the image formation apparatus is measured just after the power switch is turned on, and the measurement result (also called the initial value) is stored and is determined to be the humidity value used for controlling the image formation apparatus later until the power switch is turned off. Thus, the following advantages can be provided:

Usually, the humidity in the image formation apparatus just after the power switch is turned on is roughly equal to the environmental moisture of the environment in which the image formation apparatus is installed. On the other hand, usually it is hard to be possible that the environmental moisture will remarkably change while the image formation apparatus is used with the power switch turned on.

According to the humidity value determination method of the invention, the humidity value (initial value) measured just after the power switch is turned on is used for controlling the image formation apparatus later until the power switch is turned off. Thus, if the image formation apparatus operates with the power switch turned on and the humidity in the apparatus differs gradually from the environmental moisture accordingly, the image formation apparatus is controlled based on the humidity value (initial value) measured just after the power switch is turned on, namely, the humidity value roughly equal to the environmental moisture.

As described above, according to the invention, a desirable humidity value can be determined in the case where it is undesirable to control the image formation apparatus based on the humidity value provided any time by the humidity sensor placed in the apparatus.

According to the image formation apparatus of the invention, the humidity in the image formation apparatus is measured by the humidity sensor just after the power switch is turned on, and the measurement result (initial value) is stored in the storage and is determined to be the humidity value used for controlling the image formation apparatus by the controller until the power switch is turned off. Thus, the following advantages can be provided:

Usually, the humidity in the image formation apparatus just after the power switch is turned on is roughly equal to the environmental moisture of the environment in which the image formation apparatus is installed. On the other hand, usually it is hard to be possible that the environmental moisture will remarkably change while the image formation apparatus is used with the power switch turned on.

According to the image formation apparatus of the invention, the humidity value (initial value) measured just after the power switch is turned on is used for controlling the image formation apparatus later until the power switch is turned off. Thus, if the image formation apparatus operates with the power switch turned on and the humidity in the apparatus differs gradually from the environmental moisture accordingly, the image formation apparatus is controlled based on the humidity value (initial value) measured just after the power switch is turned on, namely, the humidity value roughly equal to the environmental moisture.

As described above, according to the invention, a desirable humidity value can be determined in the case where it is undesirable to control the image formation apparatus based on the humidity value provided any time by the humidity sensor placed in the apparatus.

According to the humidity value determination method in the image formation apparatus of the invention, the humidity in the image formation apparatus is measured just after the power switch is turned on, and the measurement result is stored and is determined to be the humidity value used for controlling the image formation apparatus later until the power switch is turned off. Later, when the power switch is turned off and is again turned on, the temperature of the fixing member is measured. When the measurement value is equal to or greater than the predetermined value, the stored measurement result is determined to be the humidity value used for controlling the image formation apparatus later until the power switch is turned off. When the measurement value of the temperature of the fixing member is less than the predetermined value, the humidity in the image formation apparatus is again measured and the new measurement result is stored and is determined to be the humidity value used for controlling the image formation apparatus later until the power switch is turned off. Thus, the following advantages can be provided:

Usually, the humidity in the image formation apparatus just after the power switch is turned on is roughly equal to the environmental moisture of the environment in which the image formation apparatus is installed. On the other hand, usually it is hard to be possible that the environmental moisture will remarkably change while the image formation apparatus is used with the power switch turned on.

According to the humidity value determination method of the invention, the humidity value (initial value) measured just after the power switch is turned on is used for controlling the image formation apparatus later until the power switch is turned off. Thus, if the image formation apparatus operates with the power switch turned on and the humidity in the apparatus differs gradually from the environmental moisture accordingly, the image formation apparatus is controlled based on the humidity value (initial value) measured just after the power switch is turned on, namely, the humidity value roughly equal to the environmental moisture.

As described above, according to the invention, a desirable humidity value can be determined in the case where it is undesirable to control the image formation apparatus based on the humidity value provided any time by the humidity sensor placed in the apparatus.

On the other hand, when the image formation apparatus is used with the power switch once turned on, trouble such that a paper jam occurs or a consumable (for example, toner) runs out may occur. In such a case, usually the user once turns off the power switch and conducts maintenance of removing the jammed paper, replacing the consumable, etc., (eliminating the trouble) and then again turns on the power switch to use the image formation apparatus. To terminate using the image formation apparatus, usually the user turns off the power switch and to again use the image formation apparatus, the user turns on the power switch.

That is, in the image formation apparatus, when the power switch is once turned on and later is turned off and then is again turned on, the time interval between the user turning off the power switch and again turning on the power switch (this time interval is called quiescent time) varies.

If the quiescent time is short, the environmental moisture scarcely changes meanwhile; if the quiescent time is long, there is a possibility that the environmental moisture will largely change meanwhile.

On the other hand, if the power switch is turned on, the fixing member is heated by warming up and becomes a high temperature. When the power switch is later turned off, the fixing member is not heated and thus the temperature thereof becomes gradually low.

According to the humidity value determination method in the image formation apparatus of the invention, the humidity in the image formation apparatus is measured just after the power switch is turned on, and the measurement result (initial value) is stored and is determined to be the humidity value used for controlling the image formation apparatus later until the power switch is turned off. Later, when the power switch is turned off and is again turned on, the temperature of the fixing member is measured.

When the measurement value (the temperature of the fixing member) is equal to or greater than the predetermined value, the stored measurement result (initial value) is determined to be the humidity value used for controlling the image formation apparatus later until the power switch is turned off.

That is, the initial value is used for the later control based on the inference that if the temperature of the fixing member is equal to or greater than the predetermined value, the quiescent time should be a short time and therefore the environmental moisture scarcely changes meanwhile.

Assuming that when the power switch is turned off and is again turned on, the humidity in the apparatus is simply measured, if the quiescent time is short, it is feared that the humidity in the apparatus may largely differ from the environmental moisture and therefore if the humidity in the apparatus is used for the later control, a problem of the fear of making it impossible to perform appropriate control occurs. However, according to the embodiment, such a problem is hard to occur.

On the other hand, when the measurement value of the temperature of the fixing member is less than the predetermined value, the humidity in the image formation apparatus is again measured and the new measurement result is stored and is determined to be the humidity value used for controlling the image formation apparatus later until the power switch is turned off.

That is, the newly measured humidity value (therefore the humidity value close to the environment moisture at the point in time) is used for the later control based on the inference that if the temperature of the fixing member is less than the predetermined value, the quiescent time should be a long time and therefore there is a possibility that the environmental moisture may largely change meanwhile.

As described above, according to the invention, a more desirable humidity value can be determined in the case where it is undesirable to control the image formation apparatus based on the humidity value provided any time by the humidity sensor provided in the apparatus.

According to the image formation apparatus of the invention, the humidity in the image formation apparatus is measured by the humidity sensor just after the power switch is turned on, and the measurement result (initial value) is stored in the storage and is determined to be the humidity value used for controlling the image formation apparatus by the controller until the power switch is turned off. Later, when the power switch is turned off and is again turned on, the temperature of the fixing member is measured by the temperature sensor. When the measurement value is equal to or greater than the predetermined value, the measurement result (initial value) stored in the storage is determined to be the humidity value used for controlling the image formation apparatus later until the power switch is turned off. When the measurement value of the temperature of the fixing member is less than the predetermined value, the humidity in the image formation apparatus is again measured by the humidity sensor and the new measurement result is stored in the storage and is determined to be the humidity value used for controlling the image formation apparatus later until the power switch is turned off. Thus, similar advantages to those provided by the humidity value determination method described above can be provided.

The humidity value determination method in the image formation apparatus of the invention is a humidity value determination method in the image formation apparatus including the fuser having the fixing member, entering the standby state if no print signal is input for a predetermined time after the power switch is turned on and warmed up later when a print signal is input, the method comprising the steps of:

measuring the temperature of the fixing member just after the print signal is input; measuring the humidity in the image formation apparatus when the measurement temperature is equal to or less than the predetermined value; and determining that the value resulting from adding a correction value to the measurement value is the humidity value used for controlling the image formation apparatus later until the power switch is turned off. Thus, according to the method, the following advantages can be provided:

If no print signal is input for a predetermined time after the power switch is turned on, the image formation apparatus (therefore the fuser) enters the standby state and later when a print signal is input, the fuser is warmed up. The time interval during which the standby state is entered, namely, the standby time varies depending on the apparatus use state of the user.

If the standby time is short, the environmental moisture scarcely changes meanwhile; if the standby time is long, there is a possibility that the environmental moisture will largely change meanwhile.

On the other hand, when the fuser 60 enters the standby state, the fixing member is heated only to by far a low temperature (for example, 30 degrees) than a fuseable (fixable) temperature (for example, 180 degrees) and thus the temperature becomes gradually low.

According to the humidity value determination method in the image formation apparatus of the invention, later when a print signal is input, the temperature of the fixing member is measured just after the print signal is input.

When the measurement temperature is equal to or less than the predetermined value, the humidity in the image formation apparatus is measured and the value resulting from adding a correction value to the measurement value is determined to be the humidity value used for controlling the image formation apparatus later until the power switch is turned off.

That is, the value resulting from adding a correction value to the newly measured humidity value is used for the later control based on the inference that if the temperature of the fixing member is equal to or less than the predetermined value, the standby time should be a long time and therefore there is a possibility that the environmental moisture may largely change meanwhile.

Assuming that the humidity in the apparatus measured when the measurement temperature of the fixing member is equal to or less than the predetermined value is used simply as the humidity, although the temperature is low in the standby mode, the fixing member is heated to a given temperature and the inside of the apparatus is affected by the temperature and an error exists between the humidity in the apparatus and the environmental moisture. Thus, a problem of the fear of making it impossible to perform appropriate control occurs. However, according to the invention, the value resulting from adding the correction value to the measurement value is determined to be the humidity value used for controlling the image formation apparatus later until the power switch is turned off, so that such a problem is hard to occur.

As described above, according to the invention, a more desirable humidity value can also be determined in the case where it is undesirable to control the image formation apparatus based on the humidity value provided any time by the humidity sensor provided in the apparatus and the fuser enters the standby state. According to the apparatus, similar advantages to those provided by the humidity value determination method described above can be provided.

According to the method, the following advantages can be provided:

When the humidity value is equal to or less than the predetermined value, the fuser is warmed up until the fixing member whose temperature increase rate is higher than that of the other reaches the predetermined temperature. That is, usual warm-up is executed. Then, paper passes through the fixing nip part. In this case, the paper was in the low-humidity environment and does not absorb much water content.

Thus, if there is a comparatively large temperature difference between the fixing members, a large difference in the dry degree does not occur between both sides of the paper and therefore the paper passing through the fixing nip part does not curl largely.

Consequently, problems of a paper jam, wrinkle occurrence, etc., become hard to occur.

On the other hand, when the humidity value is higher than the predetermined value, the fuser is additionally warmed up for the predetermined time after the fixing member whose temperature increase rate is higher reaches the predetermined temperature. As the additional warm-up is executed, the fixing member whose temperature increase rate is lower is furthermore heated, so that the temperature difference between the fixing members lessens.

Therefore, later, if paper placed in the high-humidity environment and absorbing much water content passes through the fixing nip part, a large difference in the dry degree does not occur between both sides of the paper and therefore the paper passing through the fixing nip part does not curl largely.

Consequently, problems of a paper jam, wrinkle occurrence, etc., also become hard to occur in the high-humidity environment.

Moreover, problems of a paper jam, wrinkle occurrence, etc., can be more reliably prevented from occurring.

If the additional warm-up is executed until the fixing member whose temperature increase rate is lower than that of the other reaches a predetermined temperature, the temperature difference between the fixing members can be reliably placed within a given value, a curl of the paper passing through the fixing nip part is suppressed more reliably, and it is made possible to more reliably suppress occurrence of problems of a paper jam, wrinkle occurrence, etc., in the high-humidity environment.

According to the image formation apparatus, the following advantages can be provided:

The humidity sensor measures the humidity and the controller performs the following control based on the measurement result:

When the humidity value is equal to or less than the predetermined value, the controller warms up the fuser until the fixing member whose temperature increase rate is higher than that of the other reaches the predetermined temperature. That is, usual warm-up is executed. Then, paper passes through the fixing nip part. In this case, the paper was in the low-humidity environment and does not absorb much water content.

Thus, if there is a comparatively large temperature difference between the fixing members, a large difference in the dry degree does not occur between both sides of the paper and therefore the paper passing through the fixing nip part does not curl largely.

Consequently, problems of a paper jam, wrinkle occurrence, etc., become hard to occur.

On the other hand, the humidity value is higher than the predetermined value, the controller additionally warms up the fuser for the predetermined time after the fixing member whose temperature increase rate is higher reaches the predetermined temperature. As the additional warm-up is executed, the fixing member whose temperature increase rate is lower is furthermore heated, so that the temperature difference between the fixing members lessens.

Therefore, later, if paper placed in the high-humidity environment and absorbing much water content passes through the fixing nip part, a large difference in the dry degree does not occur between both sides of the paper and therefore the paper passing through the fixing nip part does not curl largely.

Consequently, problems of a paper jam, wrinkle occurrence, etc., also become hard to occur in the high-humidity environment.

Moreover, problems of a paper jam, wrinkle occurrence, etc., can be more reliably prevented from occurring.

If a temperature sensor is provided for measuring temperature of the fixing member whose temperature increase rate is lower than that of the other and the controller is a controller for additionally warming up the fuser until the fixing member whose temperature increase rate is lower reaches a predetermined temperature based on the temperature measured by the temperature sensor, the temperature difference between the fixing members can be reliably placed within a given value, a curl of the paper passing through the fixing nip part is suppressed more reliably, and it is made possible to more reliably suppress occurrence of problems of a paper jam, wrinkle occurrence, etc., in the high-humidity environment.

If the predetermined temperature applied to the fixing member whose temperature increase rate is lower is made lower than the predetermined temperature applied to the fixing member whose temperature increase rate is higher, the time required for the additional warm-up can be shortened.

BRIEF DESCRIPTION OF THE DRAWINGS

The above objects and advantages of the present invention will become more apparent by describing in detail preferred exemplary embodiments thereof with reference to the accompanying drawings, wherein:

FIG. 6 is a drawing to show a table providing a summary of the experimental results on additional warm-up;

FIG. 7 is a drawing to show a table providing a summary of the results of experimental example 1 on the humidity value determination method and the additional warm-up;

FIG. 8 is a drawing to show a table providing a summary of the results of experimental example 2 on the humidity value determination method and the additional warm-up;

FIG. 9 is a drawing to show a table providing a summary of the results of comparison experimental example on the humidity value determination method and the additional warm-up.

DETAILED DESCRIPTION OF THE PREFERRED EMBODIMENTS

Figure 1:
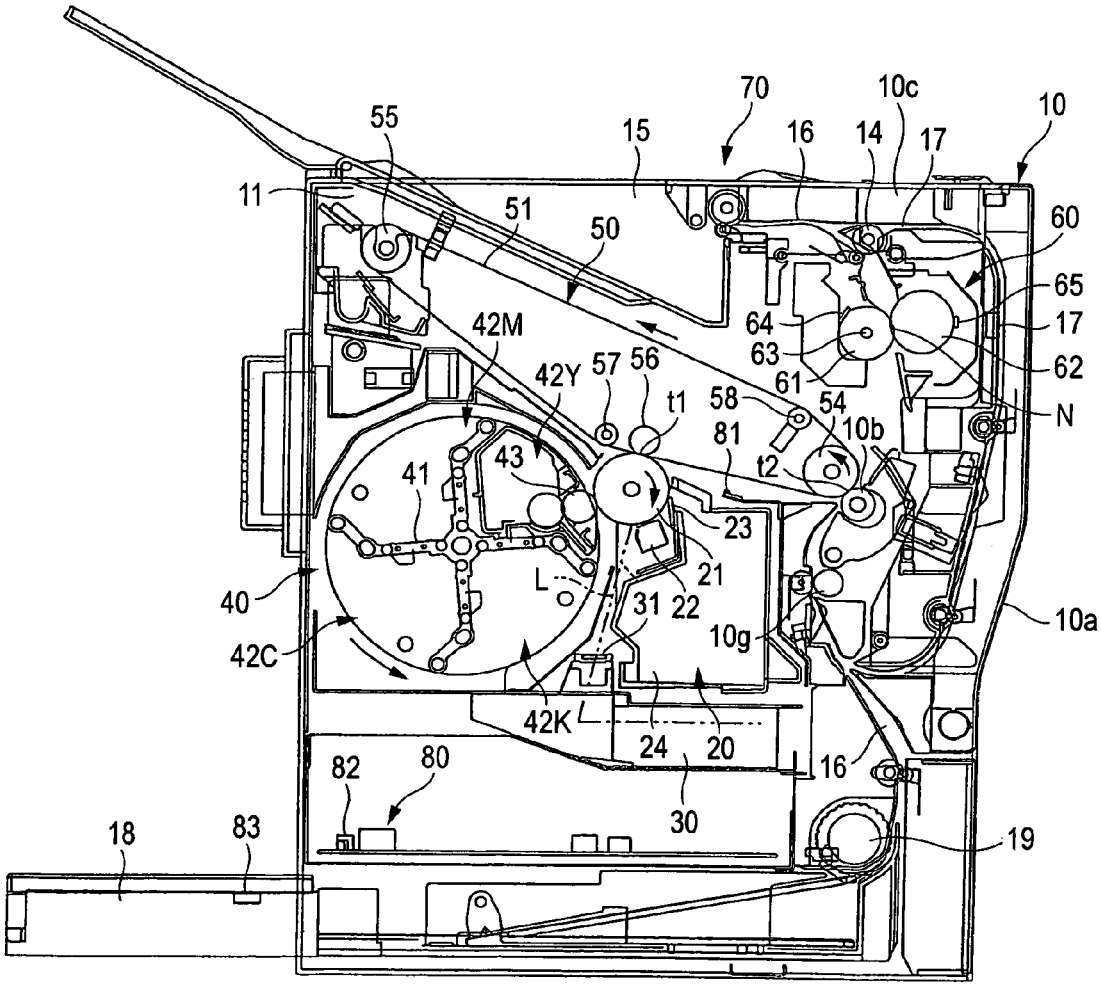
FIG. 1 is a schematic side view to show the internal structure of one embodiment of an image formation apparatus using a warm-up method of a fuser according to the invention.

FIG. 1 is a schematic side view to show the internal structure of one embodiment of an image formation apparatus using a humidity value determination method and a warm-up method of a fuser using the humidity value determination method according to the invention.

The image formation apparatus is a color image formation apparatus that can form a full-color image on both sides of almost A3-size paper at the maximum; it includes a case 10, an image formation section having an image support unit 20, a light exposure unit 30, a developing device 40, an intermediate transfer body unit 50, and a fixing unit 60 of a fuser housed in the case 10, a transport passage 16 for transporting paper formed with an image on one side (or both sides as described later) by the image formation section toward a paper ejection tray 15 of a paper ejection section, a return passage 17 for switching back the paper transported toward the paper ejection section 15 through the transport passage 16 for returning the paper toward the image formation section to form an image also on an opposite side, and a controller 80 as a controller for controlling the whole apparatus. A paper ejection roller section 70 is placed before the paper ejection tray 15.

The case 10 contains a frame (not shown) of the whole apparatus to which the units, etc., are attached.

The image support unit 20 has a photoconductor (image support) 21 having a photosensitive layer on an outer peripheral surface thereof and a charging member 22 (scorotron charger) for uniformly charging the outer peripheral surface of the photoconductor 21. The image support unit 20 selectively exposes the outer peripheral surface of the photoconductor 21 uniformly charged by the charging member 22 with laser light L from the light exposure unit 30 for forming an electrostatic latent image, gives toner of a developer to the electrostatic latent image in the developing device 40 for producing a visible image (toner image), primary-transfers the toner image to an intermediate transfer belt (an example of intermediate transfer medium) 51 of the intermediate transfer body unit 50 in a primary transfer part t1, and further secondary-transfers the image to paper of a transfer target in a secondary transfer part t2.

The image support unit 20 is provided with a cleaning member (cleaning blade) 23 for removing the remaining toner on the surface of the photoconductor 21 after the primary transfer and a waste toner storage section 24 for storing waste toner removed by the cleaning member 23.

The case 10 contains the transport passage 16 for transporting paper from a paper feed tray 18 (described later) to the secondary transfer part t2 and transporting the paper formed with an image on one side in the secondary transfer part t2 toward the paper ejection tray 15 by the paper ejection roller section 70 on the top of the case 10, and the return passage 17 for switching back the paper transported midway toward the paper ejection roller section 70 and the paper ejection section 15 through the transport passage 16 for returning the paper toward the secondary transfer part t2 to form an image also on an opposite side.

the paper feed tray 18 for stacking a plurality of sheets of paper and a paper feed roller 19 for feeding one sheet at a time toward the secondary transfer part t2 are placed on a lower portion of the case 10.

A gate roller log for controlling the supply timing of paper to the secondary transfer part t2 is placed in the path from the transport passage 16 and the return passage 17 to the secondary transfer part t2.

The developing device 40 is a rotary developing device and a plurality of developing device cartridges each storing toner are detachably attached to a rotation body main unit 41. In the embodiment, a yellow developing device cartridge 42Y, a magenta developing device cartridge 42M, a cyan developing device cartridge 42C, and a black developing device cartridge 42K are provided (in the figure, only the yellow developing device cartridge 42Y is drawn directly). As the rotation body main unit 41 rotates at 90-degree pitches in the arrow direction, a developing roller 43 can be selectively pressed against the photoconductor 21 for selectively developing the surface of the photoconductor 21.

The light exposure unit 30 applies the laser light L to the photoconductor 21 through a light exposure window 31 implemented as plate glass, etc.

The intermediate transfer body unit 50 includes a unit frame (not shown), a drive roller 54, a driven roller 55, a primary transfer roller 56, a guide roller 57 for stabilizing the state of the intermediate transfer belt 51 in the primary transfer part t1, and a tension roller 58 which are supported on the unit frame for rotation, and the intermediate transfer belt 51 as the intermediate transfer medium stretched on the rollers. The intermediate transfer belt 51 is circulated in the arrow direction in the figure. The primary transfer part t1 is formed between the photoconductor 21 and the primary transfer roller 56, and the secondary transfer part t2 is formed in the press part of the drive roller 54 and a secondary transfer roller 10*b* placed on the main unit side.

The secondary transfer roller 10*b* can be brought into and out of contact with the drive roller 54 (and therefore the intermediate transfer belt 51). When the secondary transfer roller 10*b* comes in contact with the drive roller 54, the secondary transfer part t2 is formed.

Therefore, to form a color image, a plurality of color toner images are superposed on each other on the intermediate transfer belt 51 with the secondary transfer roller 10*b* out of contact with the intermediate transfer belt 51 and then the secondary transfer roller 10*b* is abutted against the intermediate transfer belt 51 and paper is supplied to the abutment part (secondary transfer part t2), whereby a color image (toner image) is transferred onto the paper.

The paper onto which the toner image is transferred passes through the press part (fixing nip part) of a roller pair 61, 62 of the fixing unit 60 (fuser), whereby the toner image is fused on the paper and the paper is transported by a transport roller pair 14 and is ejected toward the paper ejection roller section 70 and the paper ejection section 15.

The fuser 60 has the fixing roller 61 and a pressurization roller 62 pressed against the fixing roller 61 for forming a fixing nip part N in the press part as two fixing members.

The fixing roller 61 contains a heating member 63 as a heat source, but the pressurization roller 62 is not provided with a heat source. Therefore, the pressurization roller 62 is heated through the fixing nip part N by the fixing roller 61.

The described image formation apparatus is connected to an image data (print signal) supply source such as a personal computer for use.

When the image formation apparatus is used with a power switch (not shown) once turned on, trouble such that a paper jam occurs or a consumable (for example, toner) runs out may occur. In such a case, usually the user once turns off the power switch and conducts maintenance of removing the jammed paper, replacing the consumable, etc., (eliminating the trouble) and then again turns on the power switch to use the image formation apparatus.

To remove jammed paper or at the maintenance time, the image formation apparatus of the embodiment enables the user to open a front cover 10*a* (see FIG. 1) or a top cover 10*c*. When either of the covers 10*a* and 10*c* is opened, if the power switch is on, automatically the power is turned off by an interlock mechanism and when all covers are closed, automatically the power is turned on.

When the power of the image formation apparatus is turned on (when the power is turned on with the power switch turned on or with all the covers closed) or when an image data print signal from the personal computer, etc., is input after the power is turned on (or when the signal is already input), the fuser 60 is warmed up.

The fuser 60 is warmed up until at least the fixing roller 61 reaches a predetermined temperature (in the embodiment, 180 degrees) as the heating member 63 heats the fixing roller 61 and the pressurization roller 62 while the fixing roller 61 and the pressurization roller 62 are rotated.

After the completion of the warm-up, paper formed with a toner image in response to the image data print signal is passed through the nip part N, whereby the toner is fused on the paper.

In the described image formation apparatus, the pressurization roller 62 is mainly heated only through the press part (fixing nip part) N against the fixing roller 61 and thus upon completion of the warm-up, the pressurization roller 62 becomes low temperature as compared with the fixing roller 61 and a large temperature difference may occur between the pressurization and fixing rollers. Thus, if paper placed in a high-humidity environment and absorbing much water content passes through the fixing nip part N, a difference in the dry degree occurs between both sides of the paper and the paper may curl largely. In the image formation apparatus shown in FIG. 1, the paper passing through the fixing nip part N curls in such a manner that the tip of the paper is directed left. If such a large curl occurs, a problem of occurrence of a paper jam in the paper path downstream from the fixing nip part N, for example, between the fixing nip part N and the transport roller pair 14, a wrinkle occurring on the paper passing through the fixing nip part N, or the like occurs.

Then, in the embodiment, the basic configuration is as follows: The humidity in the image formation apparatus is measured just after the user turns on the power switch, and the measurement result is stored and is determined to be the humidity value used for controlling the image formation apparatus later until the user turns off the power switch. More particularly, the humidity in the image formation apparatus is measured just after the user turns on the power switch, and the measurement result is stored and is determined to be the humidity value used for controlling the image formation apparatus later until the user turns off the power switch. Later, when the user turns off the power switch and again turns on the power switch, the temperature of the fixing member is measured and when the measurement value is equal to or greater than a predetermined value, the stored measurement result is determined to be the humidity value used for controlling the image formation apparatus later until the user turns off the power switch. When the measurement value of the temperature of the fixing member is less than the predetermined value, again the humidity in the image formation apparatus is measured and the new measurement result is stored and is determined to be the humidity value used for controlling the image formation apparatus later until the user turns off the power switch. Based on the humidity value thus determined, when the humidity value is less than the predetermined value, the fuser is warmed up until the fixing roller 61 reaches the predetermined temperature; when the humidity value is higher than the predetermined value, the fuser is additionally warmed up for a predetermined time after the fixing roller 61 reaches the predetermined temperature.

In FIG. 1, numeral 81 denotes a humidity sensor for measuring the humidity in the apparatus and numeral 64 denotes a temperature sensor for measuring the temperature of the fixing roller 61. The sensors are connected to the controller 80. The interlock mechanism described above is also electrically connected to the controller 80.

Based on the humidity measured by the humidity sensor 81, when the humidity is low, the controller 80 warms up the fuser until the fixing roller 61 reaches the predetermined temperature; when the humidity is high, the controller 80 additionally warms up the fuser for a predetermined time after the fixing roller 61 reaches the predetermined temperature.

Control of the controller 80 will be discussed specifically.

Figure 2:
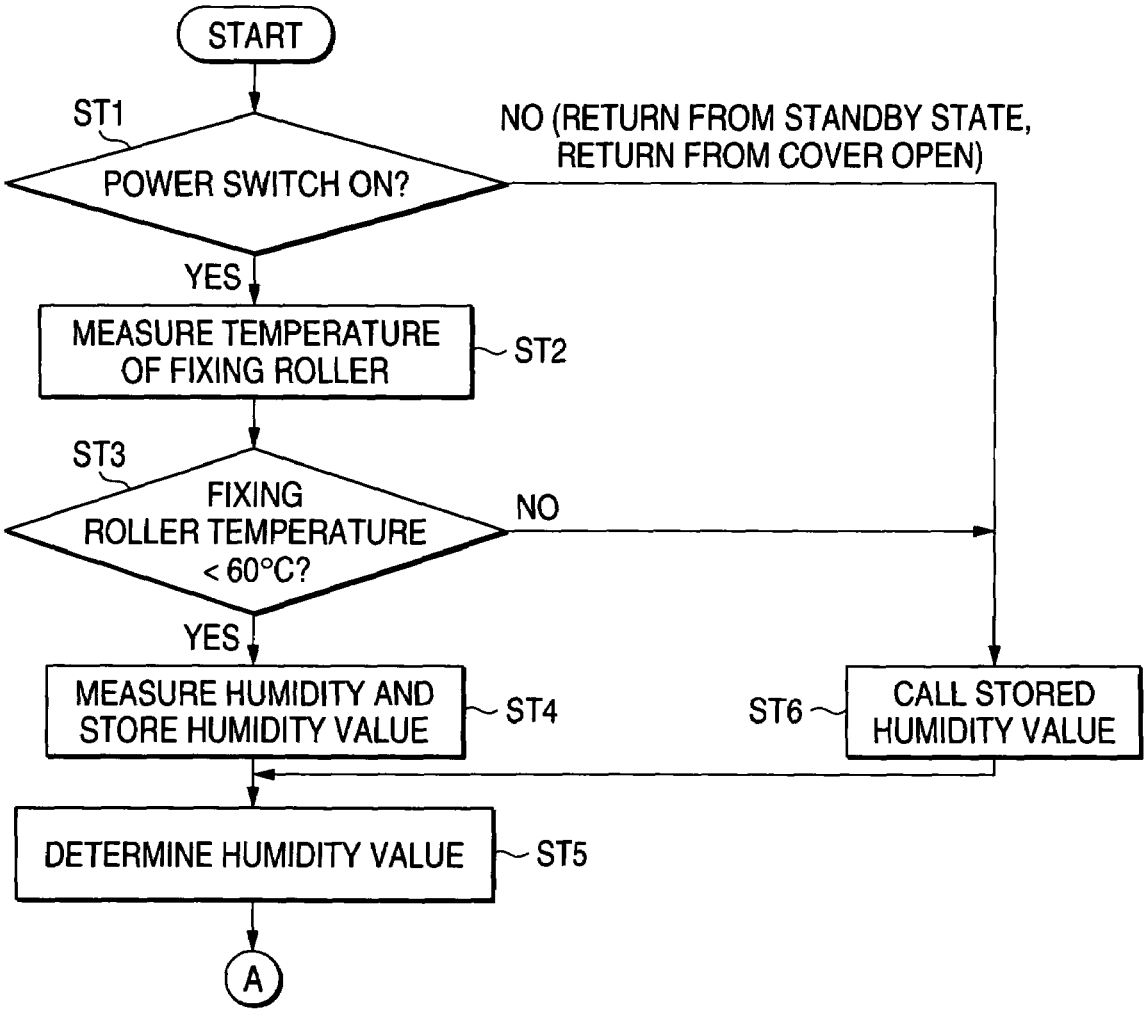
FIG. 2 is a flowchart to show a first humidity value determination method.
Figure 3:
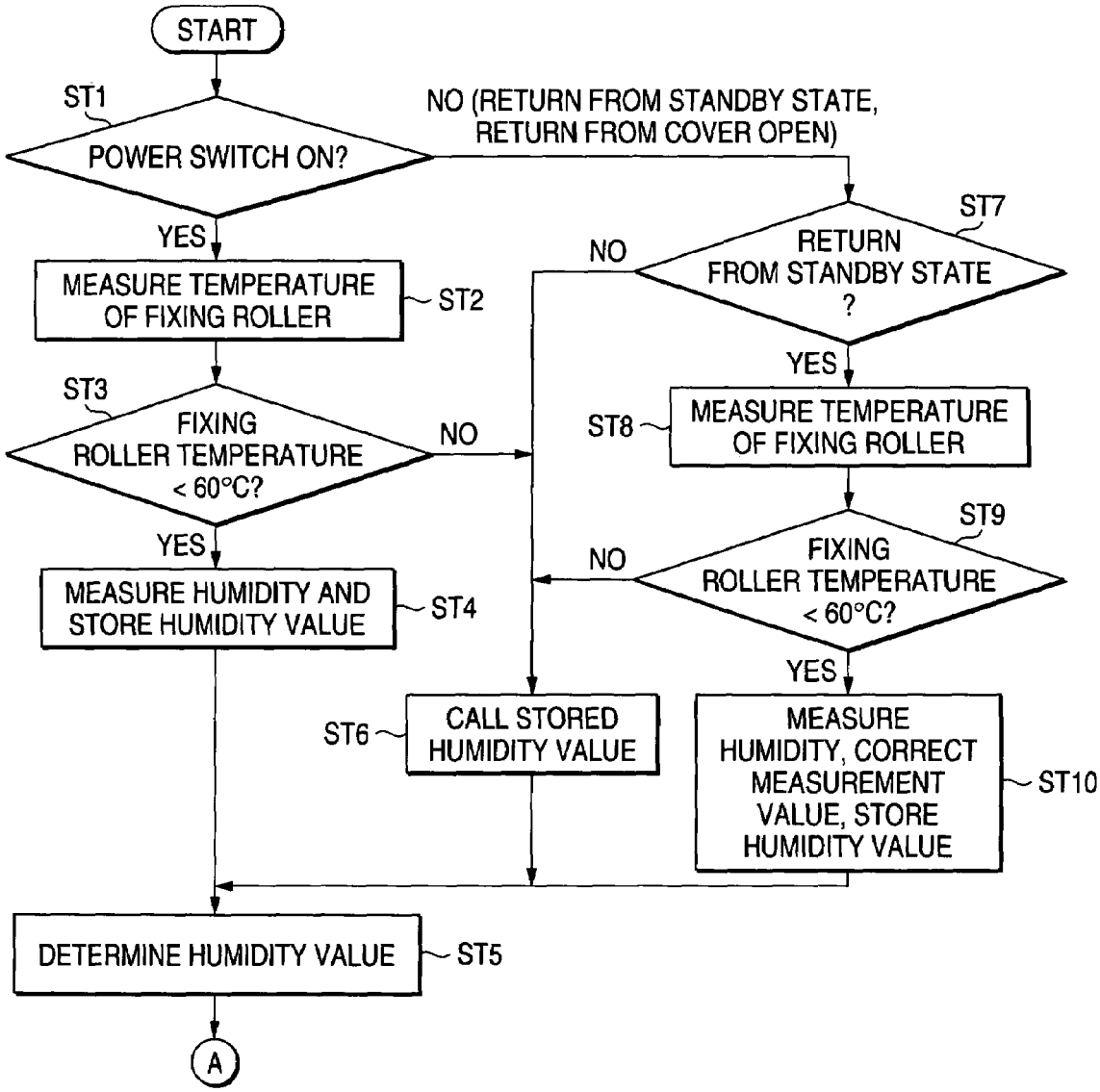
FIG. 3 is a flowchart to show a second humidity value determination method.
Figure 4:
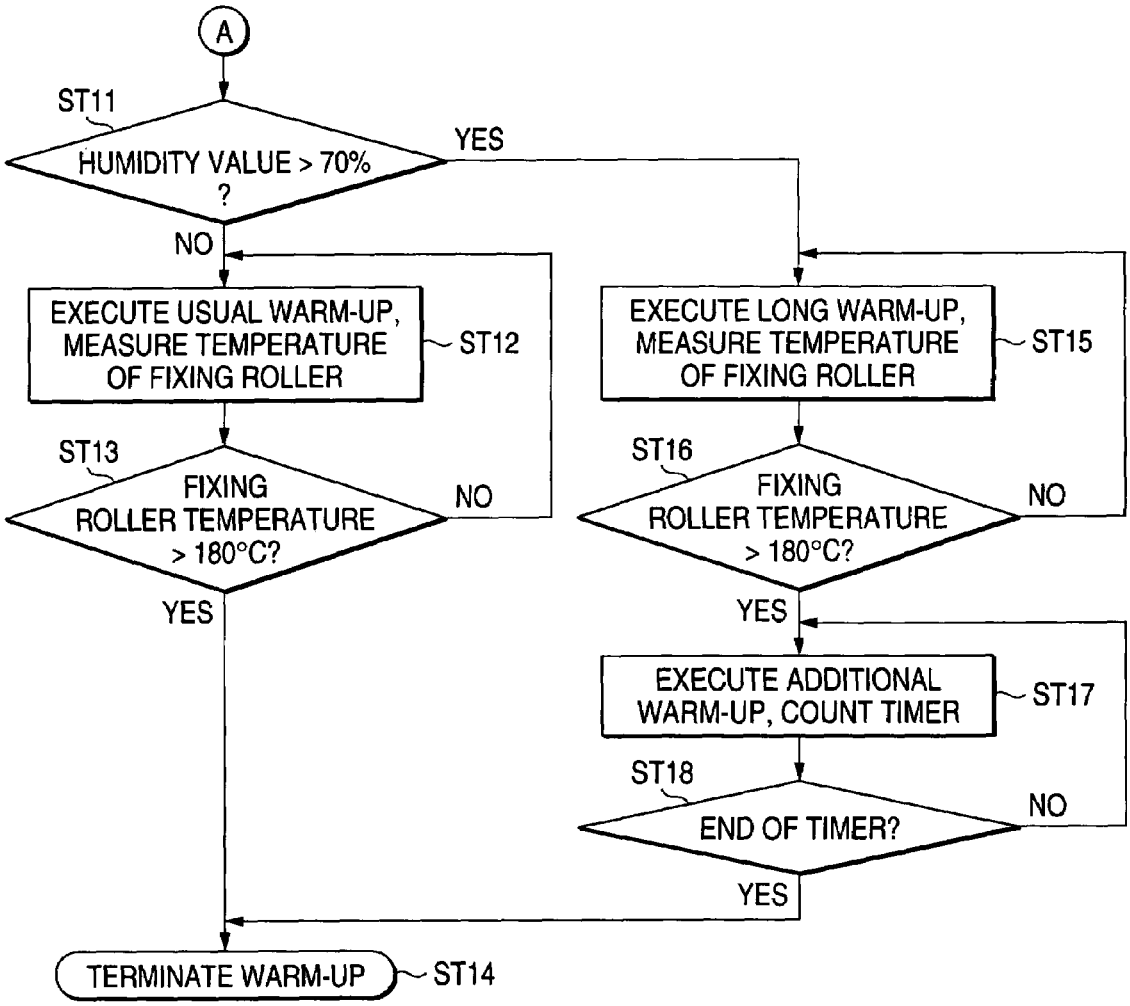
FIG. 4 is a flowchart to show the warm-up method of the fuser.

When the power of the image formation apparatus is turned on (when the power is turned on with the power switch turned on or with the covers closed) or when an image data print signal from the personal computer, etc., is input after the power is turned on (or when the signal is already input), the controller 80 performs control shown in flowcharts of FIG. 2 or 3 and FIG. 4.

FIG. 2 is a flowchart to show a first humidity value determination method. The method is as follows:

(i) At step ST1, whether or not the power switch is turned on is determined.

(ii) If the power switch is determined to be turned on, the temperature of the fixing roller 61 is measured by the temperature sensor 64 at step ST2 and whether or not the measurement value is less than a predetermined value (in this case, 60 degrees) is determined at step ST3.

(iii) If the measurement value is less than the predetermined value, humidity is measured by the humidity sensor 81 and the measurement result is stored in a storage member 82 (see FIG. 1) at step ST4 and the measurement result is determined to be the humidity value at step ST5.

(iv) If it is not determined at step ST1 that the power switch is turned on, it is determined that the power is turned on as the cover is closed or that a print signal is input. Then, at step ST6, the measurement result stored in the storage member 82 (measurement value stored according to the preceding control) is called and the measurement result is determined to be the humidity value at step ST5.

Therefore, the storage member 82 is implemented as a storage for retaining the storage contents if the power is turned off.

If the measurement value of the temperature of the fixing roller 61 is equal to or greater than the predetermined value (60 degrees) at step ST3, the process also goes to step ST6 and the measurement result stored in the storage member 82 (measurement value stored according to the preceding control) is called and at step ST5, the measurement result is determined to be the humidity value.

The description of the first humidity value determination method is now complete.

FIG. 3 is a flowchart to show a second humidity value determination method. The method can be used instead of the first humidity value determination method.

Steps ST1 to ST5 of the second humidity value determination method are the same as those of the first humidity value determination method; the second humidity value determination method differs from the first and second humidity value determination method in the following:

(iv) If it is not determined at step ST1 that the power switch is turned on, it is determined that the power is turned on as the cover is closed or that a print signal is input. Then, at step ST7, whether or not the state is return from the standby state is determined. If the state is not return from the cover open state, the state is return from the standby state (return as a print signal is input).

(v) If it is determined at step ST7 that the state is return from the standby state, the temperature of the fixing roller 61 is measured by the temperature sensor 64 at step ST8 and whether or not the measurement value is less than a predetermined value (in this case, 60 degrees) is determined at step ST9.

(vi) If the measurement value is less than the predetermined value, humidity is measured by the humidity sensor 81 and the value resulting from adding a correction value to the measurement value (post-correction value) is stored in the storage member 82 at step ST10 and the post-correction value (new humidity value) is determined to be the humidity value at step ST5.

Although the temperature of the fixing roller 61 is low in the standby mode, the fixing roller 61 is heated to a given temperature (in the embodiment, 30 degrees) and the inside of the apparatus is affected by the temperature and an error exists between the humidity in the apparatus and the environmental moisture. Thus, the correction value can be determined considering the internal structure of the apparatus and the fixing roller temperature in the standby mode or based on experiment, etc., to correct the error. In the embodiment, the correction value is +7%.

(vii) If it is not determined at step ST7 that the state is return from the standby state, namely, if it is determined that the state is return from the cover open state or if it is determined at step ST3 or step ST9 that the temperature of the fixing roller 61 is equal to or greater than the predetermined value (in this case, 60 degrees), the process goes to step ST6 and the measurement result stored in the storage member 82 (measurement value stored according to the preceding control) is called and at step ST5, the measurement result is determined to be the humidity value.

The description of the second humidity value determination method is now complete.

FIG. 4 is a flowchart to show the warm-up method of the fuser 60.

The controller 80 further performs the following warm-up control based on the humidity value (humidity information) determined by the first or second humidity value determination method:

(i) At step ST11, whether or not the humidity value determined at step ST5 is higher than a predetermined value (in this case, 70%) is determined.

(ii) If it is determined at step ST11 that the humidity value is equal to or less than the predetermined value, a usual warm-up mode is entered at step ST12. At steps ST12 and ST13, while the temperature of the fixing roller 61 is measured by the temperature sensor 64, the fuser 60 is warmed up until the fixing roller 61 reaches a predetermined temperature (in this case, 180 degrees).

(iii) When the fixing roller 61 reaches the predetermined temperature, the warm-up is complete at ST14. If a print signal exists, the print operation (image formation operation) is performed; if no print signal exists, the standby state is entered.

(iv) If it is determined at step ST11 that the humidity value is higher than the predetermined value, a long warm-up mode is entered at step ST15. In the mode, first, at steps ST15 and ST16, while the temperature of the fixing roller 61 is measured by the temperature sensor 64, the fuser 60 is warmed up until the fixing roller 61 reaches a predetermined temperature (in this case, 180 degrees).

(v) Next, when the fixing roller 61 reaches the predetermined temperature, an additional warm-up mode is entered at ST17 and counting of a timer provided in the controller 80 is started. At steps ST17 and ST18, the fuser 60 is additionally warmed up until the expiration of a predetermined time (in this case, 30 seconds).

(vi) When the predetermined time has elapsed, the warm-up is complete at ST14. If a print signal exists, the print operation (image formation operation) is performed; if no print signal exists, the standby state is entered.

The description of the warm-up method is now complete. The additional warm-up can also be executed until the pressurization roller 62 of the fixing member whose temperature increase rate is lower than that of the other fixing member reaches a predetermined temperature.

Figure 5:
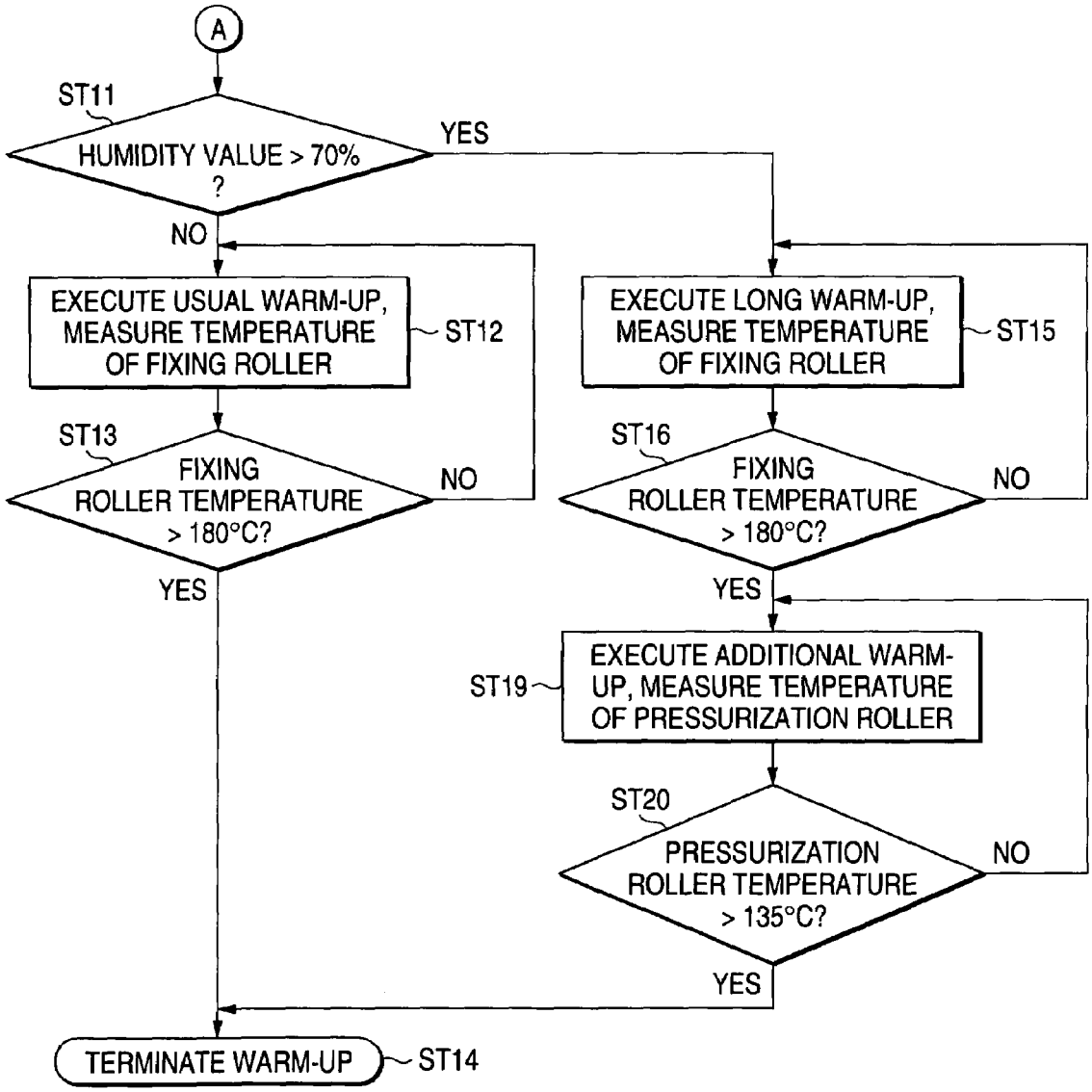
FIG. 5 is a flowchart to show a modification of the warm-up method of the fuser.

That is, at steps S19 and S20, for example, as shown in a flowchart of FIG. 5, in place of steps ST17 and ST18, while the temperature of the pressurization roller 62 is measured by a temperature sensor 65 (see FIG. 1), the fuser 60 cab also be additionally warmed up until the pressurization roller 62 reaches a predetermined temperature (which is lower than the temperature of the fixing roller 61; in this case, 135 degrees).

According to the humidity value determination methods, the fuser warm-up method, and the image formation apparatus as described above, the following advantages can be provided:

According to the humidity value determination methods and the image formation apparatus of the embodiment, the humidity in the image formation apparatus is measured by the humidity sensor 81 just after the power switch is turned on, and the measurement result (initial value) is stored in the storage member 82 and is determined to be the humidity value used for controlling the image formation apparatus later until the power switch is turned off. Thus, the following advantages can be provided:

Usually, the humidity in the image formation apparatus just after the power switch is turned on is roughly equal to the environmental moisture of the environment in which the image formation apparatus is installed. Also, usually it is hard to be possible that the environmental moisture will remarkably change while the image formation apparatus is used with the power switch turned on.

According to the humidity value determination method of the embodiment, the humidity value (initial value) measured just after the power switch is turned on is used for controlling the image formation apparatus later until the power switch is turned off. Thus, if the image formation apparatus operates with the power switch turned on and the humidity in the apparatus differs gradually from the environmental moisture accordingly, the image formation apparatus is controlled based on the humidity value (initial value) measured just after the power switch is turned on, namely, the humidity value roughly equal to the environmental moisture.

Therefore, a desirable humidity value can be determined in the case where it is undesirable to control the image formation apparatus based on the humidity value provided any time by the humidity sensor placed in the apparatus.

On the other hand, when the image formation apparatus is used with the power switch once turned on, trouble such that a paper jam occurs or a consumable (for example, toner) runs out may occur. In such a case, usually the user once turns off the power switch and conducts maintenance of removing the jammed paper, replacing the consumable, etc., (eliminating the trouble) and then again turns on the power switch to use the image formation apparatus. To terminate using the image formation apparatus, usually the user turns off the power switch and to again use the image formation apparatus, the user turns on the power switch.

That is, in the image formation apparatus, when the power switch is once turned on and later is turned off and then is again turned on, the time interval between the user turning off the power switch and again turning on the power switch (this time interval is called quiescent time) varies.

If the quiescent time is short, the environmental moisture scarcely changes meanwhile, whereas if the quiescent time is long, there is a possibility that the environmental moisture will largely change meanwhile.

On the other hand, if the power switch is turned on, the fixing member is heated by warming up and becomes a high temperature. When the power switch is later turned off, the fixing member is not heated and thus the temperature thereof becomes gradually low.

According to the humidity value determination method of the embodiment, the humidity in the image formation apparatus is measured just after the power switch is turned on, and the measurement result (initial value) is stored and is determined to be the humidity value used for controlling the image formation apparatus later until the power switch is turned off. Later, when the power switch is turned off and is again turned on, the temperature of the fixing member is measured (steps ST1 and ST2 in FIG. 2).

When the measurement value (the temperature of the fixing member) is equal to or greater than the predetermined value, the stored measurement result (initial value) is determined to be the humidity value used for controlling the image formation apparatus later until the power switch is turned off (steps ST3, ST6, and ST5 in FIG. 2).

That is, the initial value is used for the later control based on the inference that if the temperature of the fixing member is equal to or greater than the predetermined value, the quiescent time should be a short time and therefore the environmental moisture scarcely changes meanwhile.

Assuming that when the power switch is turned off and is again turned on, the humidity in the apparatus is simply measured, if the quiescent time is short, it is feared that the humidity in the apparatus may largely differ from the environmental moisture and therefore if the humidity in the apparatus is used for the later control, a problem of the fear of making it impossible to perform appropriate control occurs. However, according to the embodiment, such a problem is hard to occur.

On the other hand, when the measurement value of the temperature of the fixing member is less than the predetermined value, the humidity in the image formation apparatus is again measured (step ST4 in FIG. 2) and the new measurement result is stored (step ST4 in FIG. 2) and is determined to be the humidity value used for controlling the image formation apparatus later until the power switch is turned off (the humidity value becomes the initial value for the next control).

That is, the newly measured humidity value (therefore the humidity value close to the environment moisture at the point in time) is used for the later control based on the inference that if the temperature of the fixing member is less than the predetermined value, the quiescent time should be a long time and therefore there is a possibility that the environmental moisture may largely change meanwhile.

As described above, according to the embodiment, a more desirable humidity value can be determined in the case where it is undesirable to control the image formation apparatus based on the humidity value provided any time by the humidity sensor provided in the apparatus.

The second humidity value determination method of the embodiment (FIG. 3) is a humidity value determination method in the image formation apparatus including the fuser having the fixing member, entering the standby state if no print signal is input for a predetermined time after the power switch is turned on and warmed up later when a print signal is input, the method comprising the steps of:

measuring the temperature of the fixing member just after the print signal is input (step ST8 from ST7 in FIG. 3); measuring the humidity in the image formation apparatus when the measurement temperature is equal to or less than the predetermined value (ST10 in FIG. 3); and determining that the value resulting from adding a correction value to the measurement value is the humidity value used for controlling the image formation apparatus later until the power switch is turned off (steps ST10 and ST5 in FIG. 3). Thus, according to the method, the following advantages can be provided:

If no print signal is input for a predetermined time after the power switch is turned on, the image formation apparatus (therefore the fuser) enters the standby state and later when a print signal is input, the fuser is warmed up. The time interval during which the standby state is entered, namely, the standby time varies depending on the apparatus use state of the user.

If the standby time is short, the environmental moisture scarcely changes meanwhile. However, if the standby time is long, there is a possibility that the environmental moisture will largely change meanwhile.

On the other hand, when the fuser 60 enters the standby state, the fixing member is heated only to by far a low temperature (for example, 30 degrees) than a fuseable (fixable) temperature (for example, 180 degrees) and thus the temperature becomes gradually low.

According to the second humidity value determination method of the embodiment, later when a print signal is input, the temperature of the fixing member is measured just after the print signal is input (step ST8 in FIG. 3).

When the measurement temperature is equal to or less than the predetermined value, the humidity in the image formation apparatus is measured and the value resulting from adding a correction value to the measurement value is determined to be the humidity value used for controlling the image formation apparatus later until the power switch is turned off (steps ST10 and ST5 in FIG. 3).

That is, the value resulting from adding a correction value to the newly measured humidity value is used for the later control based on the inference that if the temperature of the fixing member is equal to or less than the predetermined value, the standby time should be a long time and therefore there is a possibility that the environmental moisture may largely change meanwhile.

Assuming that the humidity in the apparatus measured when the measurement temperature of the fixing member is equal to or less than the predetermined value is used simply as the humidity, although the temperature is low in the standby mode, the fixing member is heated to a given temperature and the inside of the apparatus is affected by the temperature and an error exists between the humidity in the apparatus and the environmental moisture. Thus, a problem of the fear of making it impossible to perform appropriate control occurs. However, according to the embodiment, the value resulting from adding the correction value to the measurement value is determined to be the humidity value used for controlling the image formation apparatus later until the power switch is turned off, so that such a problem is hard to occur.

The fuser warm-up method of the embodiment is a warm-up method of the fuser 60 having at least two fixing members 61 and 62 for forming the fixing nip part N, the two fixing members being different in the temperature increase rate at the warm-up time, the method comprising the steps of:

warming up the fuser 60 until the fixing member 61 whose temperature increase rate is higher than that of the other reaches a predetermined temperature when the humidity value determined by the humidity value determination method is less than the predetermined value (steps ST11 to ST14 in FIG. 4); and when the humidity value is higher than the predetermined value, additionally warming up the fuser 60 for a predetermined time after the fixing member 61 whose temperature increase rate is higher reaches the predetermined temperature (steps ST15 to ST18). Thus, according to the method, the following advantages can be provided:

When the humidity value is less than the predetermined value, the fuser 60 is warmed up until the fixing member 61 whose temperature increase rate is higher than that of the other reaches the predetermined temperature. That is, usual warm-up is executed (steps ST12 and ST13). Then, paper passes through the fixing nip part. In this case, the paper is in the low-humidity environment and does not absorb much water content.

Thus, if there is a comparatively large temperature difference between the fixing members 61 and 62, a large difference in the dry degree does not occur between both sides of the paper and therefore the paper passing through the fixing nip part N does not curl largely.

Consequently, problems of a paper jam, wrinkle occurrence, etc., become hard to occur.

On the other hand, when the humidity value is higher than the predetermined value, the fuser 60 is additionally warmed up for the predetermined time after the fixing member 61 whose temperature increase rate is higher reaches the predetermined temperature (steps ST15 to ST18). As the additional warm-up is executed, the fixing member 62 whose temperature increase rate is lower is furthermore heated, so that the temperature difference between the fixing members 61 and 62 lessens.

Therefore, later, if paper placed in the high-humidity environment and absorbing much water content passes through the fixing nip part N, a large difference in the dry degree does not occur between both sides of the paper and therefore the paper passing through the fixing nip part N does not curl largely.

Consequently, problems of a paper jam, wrinkle occurrence, etc., also become hard to occur in the high-humidity environment.

Moreover, the humidity value is the humidity value determined by the humidity value determination method described above, so that problems of a paper jam, wrinkle occurrence, etc., can be more reliably prevented from occurring.

If the additional warm-up is executed until the fixing member 62 whose temperature increase rate is lower than that of the other reaches a predetermined temperature (see FIG. 5), the temperature difference between the fixing members 61 and 62 can be reliably placed within a given value, a curl of the paper passing through the fixing nip part N is suppressed more reliably, and it is made possible to more reliably suppress occurrence of problems of a paper jam, wrinkle occurrence, etc., in the high-humidity environment.

The predetermined temperature applied to the fixing member 62 whose temperature increase rate is lower is made lower than the predetermined temperature applied to the fixing member 61 whose temperature increase rate is higher, so that the time required for the additional warm-up can be shortened.

<Experimental Example on Additional Warm-Up Method>

FIG. 6 is a table providing a summary of the experimental results on the additional warm-up.

In the experiment, the environmental moisture was changed to 50%, 60%, 70%, 80%, and 85% at 25-degree environmental temperature and paper water content (water content/paper weight) was measured in each environment and the temperature of the pressurization roller 62 and the presence or absence of a paper jam were examined in the case where image formation was conducted (therefore paper was passed through the fuser 60) after only the usual warm-up (warm-up time=about 90 seconds) was executed and the case where image formation was conducted after the usual warm-up and the additional warm-up (additional warm-up time=30 seconds) were executed.

As a result, when the environmental moisture was equal to or less than 70%, a paper jam did not occur in the case of "only usual warm-up" or the case of "usual warm-up plus additional warm-up."

The temperature of the pressurization roller 62 at the time was 113 to 115 degrees and the difference between the temperatures of the pressurization roller 62 and the fixing roller 61 (180 degrees) was large, but the paper water content was low (8% or less) and thus a large curl did not occur and therefore it is considered that a paper jam did not occur either.

On the other hand, when the environmental moisture was equal to or greater than 80%, a paper jam occurred in the case of "only usual warm-up," but did not occur in the case of "usual warm-up plus additional warm-up."

The paper water content at the time was 11% or more and the temperature of the pressurization roller 62 in the case of "only usual warm-up" was 112 degrees and the difference between the temperatures of the pressurization roller 62 and the fixing roller 61 (180 degrees) was large. Thus, it is considered that a large difference in the dry degree occurred between both sides of the paper, causing a large curl to occur, causing the paper jam to occur. On the other hand, in the case of "usual warm-up plus additional warm-up," the temperature of the pressurization roller 62 was 138 degrees and the difference between the temperatures of the pressurization roller 62 and the fixing roller 61 (180 degrees) lessened. Thus, it is considered that a large curl did not occur and a paper jam did not occur either although the paper water content was much.

In the experiment, no experiment was conducted on return from the standby state or the cover open/closed state described later.

<Experimental Example 1 on Humidity Value Determination Method and Warm-Up Method>

FIG. 7 is a table providing a summary of the results of experimental example 1 on the humidity value determination method and the additional warm-up.

In the experiment, the image formation apparatus using the first humidity value determination method shown in FIG. 2 and the warm-up method shown in FIG. 4 was used to form images in the following situations in an environment of environmental temperature 25 degrees and environmental moisture 75%, and whether or not a paper jam occurred was checked:

1. Situation 1: After the image formation apparatus was let alone for a long time (24 hours) with the power switch off, the power switched was turned on and an image was formed (a print signal was input).

The temperature of the fixing roller 61 was 25 degrees just after the power switched was turned on and therefore according to steps ST1 to ST5 in FIG. 2, the humidity 75% was measured and the measurement value 75% was determined to be the humidity value and was stored in the storage member 82.

Therefore, according to steps ST11 and ST15 to ST18 in FIG. 4, the additional warm-up was executed and then an image was formed.

A paper jam did not occur.

2. Situation 2: Just after the experiment in situation 1 described above, the cover 10*a* or 10*c* was opened and immediately was closed and an image was formed.

Since the return was not return as the power switch was turned on, according to steps ST1, ST6, and ST5 in FIG. 2, the humidity value stored in the storage member in situation 1 described above was called and the stored value was determined to be the humidity value.

Therefore, according to steps ST11 and ST15 to ST18 in FIG. 4, the additional warm-up was executed and then an image was formed.

A paper jam did not occur.

3. Situation 3: After the experiment in situation 2 described above, a print signal was not input for a predetermined time, thereby placing the image formation apparatus in the standby state, and an image was formed after the expiration of five minutes since the standby state was entered.

Since the return was not return as the power switch was turned on, according to steps ST1, ST6, and ST5 in FIG. 2, the humidity value stored in the storage member in situation 1 described above was called and the stored value was determined to be the humidity value.

Therefore, according to steps ST11 and ST15 to ST18 in FIG. 4, the additional warm-up was executed and then an image was formed.

A paper jam did not occur.

4. Situation 4: After the experiment in situation 3 described above, a print signal was not input for a predetermined time, thereby again placing the image formation apparatus in the standby state, and an image was formed after the expiration of one hour since the standby state was entered.

Since the return was not return as the power switch was turned on, according to steps ST1, ST6, and ST5 in FIG. 2, the humidity value stored in the storage member in situation 1 described above was called and the stored value was determined to be the humidity value.

Therefore, according to steps ST11 and ST15 to ST18 in FIG. 4, the additional warm-up was executed and then an image was formed.

A paper jam did not occur.

5. Situation 5: After the experiment in situation 4 described above, the power switch was turned off and was again turned on in 10 minutes and an image was formed.

Since the power switch was turned on, the temperature of the fixing roller 61 was measured according to steps ST1 and ST2 in FIG. 2. Since the measurement value was 100 degrees (>60 degrees), the humidity value stored in the storage member in situation 1 described above was called and the stored value was determined to be the humidity value according to steps ST3, ST6, and ST5.

Therefore, according to steps ST11 and ST15 to ST18 in FIG. 4, the additional warm-up was executed and then an image was formed.

A paper jam did not occur.

6. Situation 6: After the experiment in situation 5 described above, the power switch was turned off and was again turned on in one hour and an image was formed.

Since the power switch was turned on, the temperature of the fixing roller 61 was measured according to steps ST1 and ST2 in FIG. 2. Since the measurement value was 30 degrees (<60 degrees), the humidity 73% in the image formation apparatus was again measured at step ST4 and the new measurement result was stored in the storage member 82 and the new measurement result 73% was determined to be the humidity value used for controlling the image formation apparatus at step ST5.

Therefore, according to steps ST11 and ST15 to ST18 in FIG. 4, the additional warm-up was executed and then an image was formed.

A paper jam did not occur.

As seen from situation 6, when the image formation apparatus was let alone for a long time with the power switch off and then the power switch is turned on, new humidity is measured and the humidity value is determined, so that the image formation apparatus is controlled based on the humidity value closer to the environmental moisture.

<Experimental Example 2 on Humidity Value Determination Method and Warm-Up Method>

FIG. 8 is a table providing a summary of the results of experimental example 2 on the humidity value determination method and the additional warm-up.

In the experiment, the image formation apparatus using the second humidity value determination method shown in FIG. 3 and the warm-up method shown in FIG. 4 was used to form images in the same situations as in experimental example 1 described above in the environment of the same environmental temperature and environmental moisture as those in experimental example 1 described above, and whether or not a paper jam occurred was checked.

1. Situation 1: After the image formation apparatus was let alone for a long time (24 hours) with the power switch off, the power switched was turned on and an image was formed (a print signal was input).

The temperature of the fixing roller 61 was 25 degrees just after the power switched was turned on and therefore according to steps ST1 to ST5 in FIG. 3, the humidity 75% was measured and the measurement value 75% was determined to be the humidity value and was stored in the storage member 82.

Therefore, according to steps ST11 and ST15 to ST18 in FIG. 4, the additional warm-up was executed and then an image was formed.

A paper jam did not occur.

2. Situation 2: Just after the experiment in situation 1 described above, the cover 10*a* or 10*c* was opened and immediately was closed and an image was formed.

Since the return was not return as the power switch was turned on or return from the standby state, according to steps ST1, ST7, ST6, and ST5 in FIG. 3, the humidity value stored in the storage member in situation 1 described above was called and the stored value was determined to be the humidity value.

Therefore, according to steps ST11 and ST15 to ST18 in FIG. 4, the additional warm-up was executed and then an image was formed.

A paper jam did not occur.

3. Situation 3: After the experiment in situation 2 described above, a print signal was not input for a predetermined time, thereby placing the image formation apparatus in the standby state, and an image was formed after the expiration of five minutes since the standby state was entered.

Since the return was not return as the power switch was turned on and was return from the standby state, the temperature of the fixing roller 61 was measured at step ST8 through steps ST1 and ST7 in FIG. 3. Since the temperature was 120 degrees and not less than 60 degrees, according to steps ST6 and ST5 in FIG. 3, the humidity value stored in the storage member in situation 1 described above was called and the stored value was determined to be the humidity value.

Therefore, according to steps ST11 and ST15 to ST18 in FIG. 4, the additional warm-up was executed and then an image was formed.

A paper jam did not occur.

4. Situation 4: After the experiment in situation 3 described above, a print signal was not input for a predetermined time, thereby again placing the image formation apparatus in the standby state, and an image was formed after the expiration of one hour since the standby state was entered.

Since the return was not return as the power switch was turned on and was return from the standby state, the temperature of the fixing roller 61 was measured at step ST8 through steps ST1 and ST7 in FIG. 3. Since the temperature was 30 degrees and less than 60 degrees (step ST9), according to step ST10, the humidity was measured and the post-correction value (75%) resulting from adding a correction value (7%) to the measurement value (68%) was stored in the storage member 82 and at step ST5, the post-correction value was determined to be the humidity value.

Therefore, according to steps ST11 and ST15 to ST18 in FIG. 4, the additional warm-up was executed and then an image was formed.

A paper jam did not occur.

5. Situation 5: After the experiment in situation 4 described above, the power switch was turned off and was again turned on in 10 minutes and an image was formed.

Since the power switch was turned on, the temperature of the fixing roller 61 was measured according to steps ST1 and ST2 in FIG. 3. Since the measurement value was 100 degrees (>60 degrees), the humidity value (post-correction value) stored in the storage member in situation 4 described above was called and the stored value was determined to be the humidity value according to steps ST3, ST6, and ST5.

Therefore, according to steps ST11 and ST15 to ST18 in FIG. 4, the additional warm-up was executed and then an image was formed.

A paper jam did not occur.

6. Situation 6: After the experiment in situation 5 described above, the power switch was turned off and was again turned on in one hour and an image was formed.

Since the power switch was turned on, the temperature of the fixing roller 61 was measured according to steps ST1 and ST2 in FIG. 3. Since the measurement value was 30 degrees (<60 degrees), the humidity 73% in the image formation apparatus was again measured at step ST4 and the new measurement result was stored in the storage member 82 and the new measurement result 73% was determined to be the humidity value used for controlling the image formation apparatus at step ST5. Therefore, according to steps ST11 and ST15 to ST18 in FIG. 4, the additional warm-up was executed and then an image was formed.

A paper jam did not occur.

As seen from situation 4 in experimental example 2, when the standby time was long, the value resulting from adding the correction value to the newly measured humidity value is used for the later control, so that the image formation apparatus is controlled based on the humidity value closer to the environmental moisture.

COMPARISON EXPERIMENTAL EXAMPLE

FIG. 9 is a table providing a summary of the results of comparison experimental example on the humidity value determination method and the additional warm-up.

Figure 10:
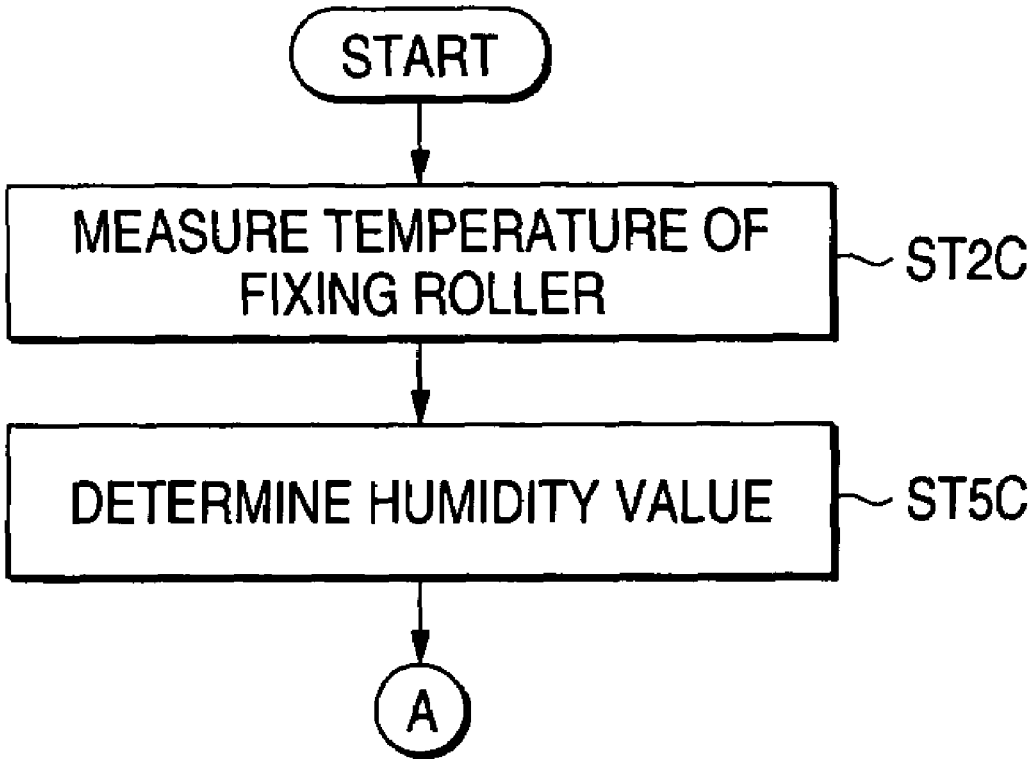
FIG. 10 is a flowchart to show a humidity value determination method as a comparison example.

In the experiment, in the image formation apparatus using a humidity value determination method shown in FIG. 10 as a comparison example and the warm-up method shown in FIG. 4, images were formed in the same situations as in experimental example 1, 2 described above in the environment of the same environmental temperature and environmental moisture as those in experimental example 1, 2 described above, and whether or not a paper jam occurred was checked. The temperature in the machine (the temperature in the apparatus) was also measured in each situation.

The humidity value determination method as a comparison example shown in FIG. 10 is a method of determining that the humidity value provided any time by the humidity sensor 81 is the humidity value used for the warm-up method as it is.

1. Situation 1: After the image formation apparatus was let alone for a long time (24 hours) with the power switch off, the power switched was turned on and an image was formed (a print signal was input).

According to steps ST2C and ST5C in FIG. 10, the humidity 75% was measured and the measurement value 75% was determined to be the humidity value.

Therefore, according to steps ST11 and ST15 to ST18 in FIG. 4, the additional warm-up was executed and then an image was formed.

A paper jam did not occur.

2. Situation 2: Just after the experiment in situation 1 described above, the cover 10*a* or 10*c* was opened and immediately was closed and an image was formed.

According to steps ST2C and ST5C in FIG. 10, the humidity 54% was measured and the measurement value 54% was determined to be the humidity value.

Therefore, according to steps ST11 to ST14 in FIG. 4, only the usual warm-up was executed and then an image was formed.

Although situation 2 was the situation just after the experiment in situation 1 described above and the environmental moisture was about 75%, the humidity in the apparatus 54% after the cover was opened and closed largely different from the real environmental moisture (about 75%) was measured and the measurement value 54% was determined to be the humidity value used for warm-up control and only the usual warm-up was executed according to steps ST2C and ST5C in FIG. 10. Thus, a paper jam occurred.

3. Situation 3: After the experiment in situation 2 described above, a print signal was not input for a predetermined time, thereby placing the image formation apparatus in the standby state, and an image was formed after the expiration of five minutes since the standby state was entered.

According to steps ST2C and ST5C in FIG. 10, the humidity 58% was measured and the measurement value 58% was determined to be the humidity value.

Therefore, according to steps ST11 to ST14 in FIG. 4, only the usual warm-up was executed and then an image was formed.

Although situation 3 was the situation after a lapse of no longer than a short time after the experiment in situation 2 described above and the environmental moisture was about 75%, the humidity in the apparatus 58% after the cover was opened and closed largely different from the real environmental moisture (about 75%) was measured and the measurement value 58% was determined to be the humidity value used for warm-up control and only the usual warm-up was executed according to steps ST2C and ST5C in FIG. 10. Thus, a paper jam occurred.

4. Situation 4: After the experiment in situation 3 described above, a print signal was not input for a predetermined time, thereby again placing the image formation apparatus in the standby state, and an image was formed after the expiration of one hour since the standby state was entered.

According to steps ST2C and ST5C in FIG. 10, the humidity 68% was measured and the measurement value 68% was determined to be the humidity value.

Therefore, according to steps ST11 to ST14 in FIG. 4, only the usual warm-up was executed and then an image was formed.

Situation 4 was the situation after a lapse of a comparatively long time of about one hour or more after the experiment in situation 3 described above and therefore the humidity in the apparatus is close to the real environmental moisture. However, although the temperature is low in the standby mode, the fixing roller 61 is heated to a given temperature and the inside of the apparatus is affected by the temperature and an error exists between the humidity in the apparatus and the environmental moisture.

Nevertheless, in the comparison example, according to steps ST2C and ST5C in FIG. 10, the humidity in the apparatus 68% having an error with the real environmental moisture was measured and the measurement value 68% was determined to be the humidity value used for warm-up control without correcting the error, and only the usual warm-up was executed. Thus, a paper jam occurred.

5. Situation 5: After the experiment in situation 4 described above, the power switch was turned off and was again turned on in 10 minutes and an image was formed.

According to steps ST2C and ST5C in FIG. 10, the humidity 60% was measured and the measurement value 60% was determined to be the humidity value.

Therefore, according to steps ST11 to ST14 in FIG. 4, only the usual warm-up was executed and then an image was formed.

Situation 5 was the situation after a lapse of no longer than 10 minutes after the experiment in situation 4 described above, namely, after image formation and therefore the temperature in the apparatus is 35 degrees higher than that in situation 4 and the humidity in the apparatus is 60% lower than that in situation 4.

Nevertheless, in the comparison example, according to steps ST2C and ST5C in FIG. 10, the humidity in the apparatus 60% largely different from the real environmental moisture was measured and the measurement value 60% was determined to be the humidity value used for warm-up control as it is, and only the usual warm-up was executed. Thus, a paper jam occurred.

6. Situation 6: After the experiment in situation 5 described above, the power switch was turned off and was again turned on in one hour and an image was formed.

According to steps ST2C and ST5C in FIG. 10, the humidity 73% was measured and the measurement value 73% was determined to be the humidity value.

Therefore, according to steps ST11 and ST15 to ST18 in FIG. 4, the additional warm-up was executed and then an image was formed.

Situation 6 was the situation after a lapse of a long time of one hour with the power off after the experiment in situation 5 described above and therefore the humidity in the apparatus is close to the real environmental moisture and the humidity in the apparatus is close to the real environmental moisture.

Thus, the additional warm-up was also executed in the comparison example and consequently, a paper jam did not occur.

Although the invention has been described in the specific embodiment, it is to be understood that the invention is not limited to the specific embodiment thereof and that various modifications may be made in the invention without departing from the spirit and scope thereof.

For example, when the additional warm-up is executed, the temperature of the fixing roller 61 is set to a predetermined temperature (for example, 180 degrees) or more, whereby it is made possible to complete the additional warm-up in a shorter time.

A humidity sensor 83 is provided in the paper feed tray (paper feed cassette) 18 or in the proximity thereof as shown in FIG. 1 and the additional warm-up is controlled based on the humidity value provided by the humidity sensor 83 (humidity value closer to the real environmental moisture), whereby it is made possible to control the additional warm-up more appropriately.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

What is claimed is:

1. A method of warming a fixing device, comprising the steps of:

providing a first fixing member and a second fixing member which comes in contact with the first fixing member;

measuring a humidity in the device;

warming the first fixing member until a temperature of the first fixing member reaches a first temperature; and warming the first fixing member additionally, so as to reduce a temperature difference between the first fixing member and the second fixing member after the temperature of the first fixing member reaches the first temperature, when the humidity is higher than a predetermined value.

2. The method as set forth in claim 1 wherein the first fixing member is additionally warmed until a temperature of the second fixing member reaches a second temperature which is lower than the first temperature when the humidity is higher than the predetermined value.

3. An image formation apparatus, comprising:

a first fixing member, a second fixing member, which comes in contact with the first fixing member;

a warming member, provided within the first fixing member;

a humidity sensor, which measures a humidity in the apparatus; and a controller, which controls the warming member, wherein the controller controls the warming member to warm the first fixing member until a temperature of the first fixing member reaches a first temperature; and wherein when the humidity is higher than a predetermined value, the controller controls the warming member to additionally warm the first fixing member so as to reduce a temperature difference between the first fixing member and the second fixing member after the temperature of the first fixing member reaches the first temperature.

4. The image formation apparatus as set forth in claim 3 further comprising a temperature sensor which measures a temperature of the second fixing member, wherein when the humidity is higher than the predetermined value, the controller controls the warming member to additionally warm the first fixing member until the temperature of the second fixing member reaches a second temperature which is lower than the first temperature.

5. A method of determining a humidity value used in an image formation apparatus, comprising the steps of:

measuring humidity in the image formation apparatus immediately after a power of the image forming apparatus is turned on;

storing a first humidity value measured in the measuring step; and determining the first humidity value as a value used for controlling the image formation apparatus until the power is turned off.

6. The method as set forth in claim 5, further comprising the steps of:

measuring temperature of a fixing member for fixing an toner image onto a sheet, when the power is again turned on;

determining the stored first humidity value as the value used for controlling the image formation apparatus until the power is turned off, when the measured temperature is equal to or greater than a predetermined value;

remeasuring the humidity in the image formation apparatus and storing a second humidity value measured in the remeasuring step, when the measured temperature is less than the predetermined value; and determining the second humidity value as the value used for controlling the image formation apparatus until the power is turned off.

7. An image formation apparatus, comprising:

a humidity sensor, which measures humidity in. the image formation apparatus immediately after a power of the image forming apparatus is turned on;

a storage, which stores a humidity value measured by the humidity sensor; and a controller, which determines the humidity value as a value used for controlling the image formation apparatus until the power is turned off.

8. An image formation apparatus, comprising:

a fixing member, which fixes a toner image onto a sheet;

a temperature sensor, which measures temperature of the fixing member;

a humidity sensor, which measures humidity in the image formation apparatus;

a storage, which is capable of storing a humidity value measured by the humidity sensor; and a controller, which determines the humidity value as a value used for controlling the image formation apparatus until the power is turned off, wherein the humidity sensor measures the humidity in the image formation apparatus immediately after the power is turned on;

wherein a first humidity value measured by the humidity sensor is stored in the storage;

wherein the first humidity value is determined as the value used for controlling the image formation apparatus until the power is turned off;

wherein the temperature of the fixing member is measured when the power is again turned on;

wherein the first humidity value stored in the storage is determined as the value used for controlling the image formation apparatus until the power is turned off, when the measured temperature is equal to or greater than a predetermined value;

wherein the humidity in the image formation apparatus is remeasured by the humidity sensor and a second humidity value remeasured by the humidity sensor is stored in the storage, when the measured temperature is less than the predetermined value; and wherein the second humidity value is determined as the value used for controlling the image formation apparatus until the power is turned off.

9. A method of determining a humidity value used in an image formation apparatus, comprising the steps of:

setting the image formation apparatus to a standby state when an image forming signal is not input for a predetermined time in on state of the image formation apparatus;

warming up a fixing member of the image forming apparatus when the image forming signal is input;

measuring temperature of the fixing member immediately after the image forming signal is input;

measuring humidity in the image formation apparatus when the temperature measured in the temperature step is less than a predetermined value;

correcting a humidity value measured in the humidity measuring step with a correction value; and determining the corrected humidity value as a value used for controlling the image formation apparatus until the power is turned off.

10. An image formation apparatus, in which the image formation apparatus is set to a standby state when an image forming signal is not input for a predetermined time in on state of the image formation apparatus, comprising:

a fixing device, which is warmed up when the image forming signal is input;

a temperature sensor, which measures temperature of the fixing device;

a humidity sensor, which measures humidity in the image formation apparatus; and a controller, which determines a humidity value as a value used for controlling the image formation apparatus until the power is turned off, wherein the temperature sensor measures the temperature of the fixing device immediately after the image forming signal is input;

wherein the humidity sensor measures the humidity in the image formation apparatus when the measured temperature is less than a predetermined value;

wherein a humidity value measured by the humidity sensor is corrected with a correction value; and wherein the corrected humidity value is determined as the value used for controlling the image formation apparatus until the power is turned off.

11. The method as set forth in claim 9, further comprising the steps of:

providing a first fixing member and a second fixing member for fixing a toner image onto a sheet, a temperature increase rate of the first fixing member being higher than that of the second fixing member;

warming up the first fixing member until a first temperature, when the humidity value determined in the determining step is equal to or less than a predetermined value; and performing an additional warm-up of the fixing device for a predetermined time after warming up the first fixing member until the first temperature, when the humidity value determined in the determining step is greater than the predetermined value.

12. The method as set forth in claim 11 wherein the additional warm-up is performed by warming up the second fixing member until a second temperature.

13. The method as set forth in claim 12 wherein the second temperature is lower than the first temperature.

14. The image formation apparatus as set forth in claim 10, wherein the fixing device has a first fixing member and a second fixing member which is arranged in contact with the first fixing member;

wherein a temperature increase rate of the first fixing member is higher than that of the second fixing member;

wherein the controller controls a warming up of the first fixing member and the second fixing member;

wherein the first fixing member is warmed up until a first temperature when the humidity value determined by the controller is equal to or less than a predetermined value; and wherein when the humidity value determined by the controller is greater than the predetermined value, an additional warm-up of the fixing device is performed for a predetermined time after the first fixing member is warmed up until the predetermined temperature.

15. The image formation apparatus as set forth in claim 14 wherein the temperature sensor measures temperature of the second fixing member; and wherein the controller performs the additionally warm up to the fixing device until a temperature of the second fixing member is reached to a second temperature, based on the temperature measured by the temperature sensor.

16. The image formation apparatus as set forth in claim 15 wherein the second temperature is lower than the first temperature.

* * * * *